US012156568B2

(12) United States Patent
Jeong et al.

(10) Patent No.: US 12,156,568 B2
(45) Date of Patent: Dec. 3, 2024

(54) SHOE

(71) Applicants: NANOTECH CERAMICS CO., LTD., Busan (KR); Sang Ok Jeong, Busan (KR)

(72) Inventors: Sang Ok Jeong, Busan (KR); Jong Min Lim, Yangsan-si (KR); Sung Young Park, Busan (KR)

(73) Assignees: NANOTECH CERAMICS CO., LTD., Busan (KR); San Ok Jeong, Busan (KR)

( * ) Notice: Subject to any disclaimer, the term of this patent is extended or adjusted under 35 U.S.C. 154(b) by 461 days.

(21) Appl. No.: 17/272,612

(22) PCT Filed: Aug. 30, 2019

(86) PCT No.: PCT/KR2019/011209
§ 371 (c)(1),
(2) Date: May 25, 2021

(87) PCT Pub. No.: WO2020/046071
PCT Pub. Date: Mar. 5, 2020

(65) Prior Publication Data

US 2021/0267312 A1 Sep. 2, 2021

(30) Foreign Application Priority Data

Aug. 30, 2018 (KR) ..... 10-2018-0102945
Jul. 24, 2019 (KR) ..... 10-2019-0089870

(51) Int. Cl.
*A43B 17/10* (2006.01)
*A43B 3/02* (2006.01)
(Continued)

(52) U.S. Cl.
CPC ..... *A43B 17/10* (2013.01); *A43B 3/02* (2013.01); *A43B 3/26* (2013.01); *A43B 7/082* (2013.01); *A43B 7/085* (2013.01); *A43B 7/18* (2013.01)

(58) Field of Classification Search
CPC .. A43B 17/10; A43B 3/02; A43B 3/26; A43B 7/082; A43B 7/085; A43B 7/18; A43B 23/04
See application file for complete search history.

(56) References Cited

U.S. PATENT DOCUMENTS 1,211,542 A * 1/1917 Patrick ..... A43B 7/085 36/3 R
1,213,941 A * 1/1917 Carolin ..... A43B 7/06 36/3 R
(Continued)

FOREIGN PATENT DOCUMENTS

JP 2003-024107 A 1/2003
JP 2011-004959 A 1/2011
(Continued)

*Primary Examiner* — Katharine G Kane
(74) *Attorney, Agent, or Firm* — NKL Law; Jae Youn Kim

(57) ABSTRACT

Disclosed are shoes including a body having a foot insertion space into which user's foot is inserted, an air passage portion protruding from a front of the body to the outside and extending in a direction in which the body extends, and a foot support portion located in a width direction of the air passage portion. In addition, shoes according to another feature includes a first body portion in which a portion of a front foot portion of a wearer is positioned, a second body portion connected to the first body portion and in which the other remaining portion of the front foot portion, a middle foot portion, and a rear foot portion of the wearer are positioned, a cover seamlessly connected to the second body portion and protruding in an outward direction from both
(Continued)

edge portions, at least one protrusion protruding from an inner surface of the cover and extending in a direction in which the second body portion extends, wherein a protruding thickness of each protrusion decreases from an upper portion toward the first body portion.

8 Claims, 22 Drawing Sheets

(51) Int. Cl.

| | |
|---|---|
| ***A43B 3/26*** | (2006.01) |
| ***A43B 7/08*** | (2022.01) |
| ***A43B 7/18*** | (2006.01) |

(56) References Cited

U.S. PATENT DOCUMENTS 2,306,306 A * 12/1942 Ferrettie ..... A43B 3/02 36/4
2,591,454 A * 4/1952 Manning ..... A43B 7/06 36/4
2,703,937 A * 3/1955 McGinn ..... A43B 7/06 36/3 R
2,756,516 A * 7/1956 Teague ..... A43B 3/02 29/34 R
3,006,084 A * 10/1961 Le Compte ..... A43B 3/02 36/58.6
3,742,623 A * 7/1973 Groothaert ..... A43B 3/02 36/4
5,245,767 A * 9/1993 Morin ..... A43B 3/0031 36/1
7,188,438 B1 * 3/2007 Bowen ..... A43B 3/18 36/7.1 R
8,146,266 B2 * 4/2012 Vattes ..... A43B 17/08 36/55
2006/0277785 A1 * 12/2006 Vattes ..... A43B 17/102 36/3 A
2008/0189988 A1 * 8/2008 Yeh ..... A43B 1/0045 36/136
2009/0084001 A1 * 4/2009 Sgattoni ..... A43B 7/082 36/3 R
2011/0078924 A1 * 4/2011 Rackiewicz ..... A43B 23/026 12/142 E
2011/0099854 A1 * 5/2011 Foster ..... A43B 1/0009 36/3 A
2011/0119958 A1 * 5/2011 Wu ..... B29D 35/0054 36/76 R
2013/0133229 A1 * 5/2013 Ludemann ..... B29D 35/0009 12/146 B
2014/0173935 A1 * 6/2014 Sabbioni ..... A43B 23/042 36/87
2015/0196084 A1 * 7/2015 Litvinov ..... A43B 7/082 36/3 R
2015/0335095 A1 * 11/2015 Lee ..... A43B 5/00 36/59 C
2016/0309835 A1 * 10/2016 Maccioni ..... A43B 13/223
2017/0150783 A1 * 6/2017 Polegato Moretti ..... A43B 13/386
2018/0042337 A1 * 2/2018 Davis ..... A43B 7/32
2018/0103715 A1 * 4/2018 Chen ..... A43B 23/028

FOREIGN PATENT DOCUMENTS

KR 20-0192510 Y1 8/2000
KR 2000-0058689 A 10/2000
KR 10-0470751 B1 3/2005
KR 10-0599635 B1 7/2006
KR 10-1710386 B1 2/2017
KR 10-1711881 B1 3/2017
KR 10-1737910 B1 5/2017
KR 10-1767884 B1 8/2017
KR 20-2017-0003150 U 9/2017
KR 10-2017-0122645 A 11/2017

* cited by examiner

SHOE

TECHNICAL FIELD

The present disclosure relates to shoes, and more particularly, to shoes with improved breathability that effectively releases sweat or moisture that occurs in the shoes.

BACKGROUND ART

As humans walk with two feet, shoes have been used to protect feet, and in line with the advancement of scientific technologies, new materials have been developed, and these days, various types of shoes suiting for various activities such as home, walking, mountain, body correction, and special exercise have been produced. These shoes are made not only to protect the feet of a person who wears them but also to pursue the convenience of activities performed in a state in which the person wears shoes.

Here, a foot inserted into a shoe forms a distribution of about 500,000 sweat glands, which occupies about 20% of a person's total sweat holes, and is the area that secretes the most sweat except for the forehead.

Accordingly, in the case of activities while wearing shoes, sweat is secreted up to about 12 times more than usual.

Therefore, although it is important to protect the wearer's feet and pursue the convenience of wearing, if breathability is not secured, the shoes become sweaty due to heat generated from the feet and foot odor occurs. Eventually, one of the important elements of shoes is to solve the problems by effectively releasing heat or sweat generated from the foot.

In order to solve this problem, in the related art, a technology of externally discharging air through a shoe insole by forming an air hole through which air may be discharged on the side or bottom surface of an outer cover exposed to the outside has been proposed. The related art include, for example, Utility Model Registration No. 20-0192510 (Air discharge shoes), Patent Laid-open Publication No. 10-2000-0035118 (Shoe Insole with air hose), and Patent Publication Registration No. 10-0470751 (Shoes capable of circulating air with outside). However, in these related art, ventilation is performed through the bottom of the shoes or the side of the shoes, and thus, water inevitably enters shoes in a case in which water gathers on the ground, which may be fatal to shoes that require a waterproof function, such as boots.

Accordingly, the inventor of the present application have proposed dual-structure shoes in which air holes are formed in an inner layer and an outer layer so that air may be discharged through instep and ankle portions. Such shoes were presented in Korean Patent Publication Registration No. 10-1737910 (Breathable shoes having dual structure at Upper part), Korean Patent Publication Registration No. 10-1711881 (Shoes having air permeability through tongue), and Korean Patent Laid-open Publication No. 10-2017-0122645 (Breathable shoes having dual structure at Upper part), and, in addition, Korean Patent Registration No. 10-1767884 (Method for manufacturing breathable boots) discloses a method of manufacturing such shoes.

DISCLOSURE

Technical Problem

Therefore, an object of the present disclosure is to improve breathability of shoes.

Another object of the present disclosure is to improve user convenience by improving a bending phenomenon of shoes.

Another object of the present disclosure is to increase convenience of use.

Another object of the present disclosure is to stably maintain a shape of shoes.

Technical Solution

According to an aspect of the present disclosure, there is provided shoes including: a body having a foot insertion space into which user's foot is inserted; an air passage portion protruding from a front of the body to the outside and extending in a direction in which the body extends; and a foot support portion located in a width direction of the air passage portion.

The shoes according to the above feature may further include an air passage located between the air passage portion and the foot support portion.

The foot support portion may be provided in plurality, and the plurality of foot support portions may be located at determined intervals in a direction in which the air passage portion extends.

The plurality of foot support portions may have different sizes.

The foot support portion may have a bar shape or a band shape.

The foot support portion may be located in a width direction of the air passage portion.

The foot support portion may have a protrusion shape protruding from the inside of the air passage portion.

The foot support portion may have a bar or band shape and may include a first foot support portion located in the width direction of the air passage portion and a second foot support portion having a protrusion shape protruding from the inside of the air passage portion.

The first foot support portion and the second foot support portion may be located to correspond to each other.

The shoes according to the above feature may further include an insole located in the foot insertion space.

The insole may include a plurality of moisture discharge portions.

Each of the plurality of moisture discharge portions may penetrate the insole in a thickness direction of the insole.

The insole may further include a plurality of bottom protrusions located on a lower surface of the insole.

The body may include a bottom portion on which the sole of the foot is positioned.

An upper surface of the bottom portion facing the insole may include an uneven surface having a concave portion and a convex portion.

The concave portion may be located to correspond to the moisture discharge portion.

The body, the air passage portion, and the foot support portion may be formed of natural rubber, synthetic rubber, or synthetic resin.

Fiber may be attached to a portion of the foot support portion adjacent to the user's body.

According to another aspect of the present disclosure, there is provided shoes including: a first body portion in which a portion of a front foot portion of a wearer is positioned; a second body portion connected to the first body portion and in which the other remaining portion of the front foot portion, a middle foot portion, and a rear foot portion of the wearer are positioned; a cover seamlessly connected to the second body portion and protruding in an outward direction from both edge portions; at least one protrusion protruding from an inner surface of the cover and extending in a direction in which the second body portion extends, wherein a protruding thickness of each protrusion decreases from an upper portion toward the first body portion.

When the protrusion is provided in plurality, the plurality of protrusions may be spaced apart from each other across the inner surface of the cover.

The shoes according to the above feature may further include a discharge passage located between two adjacent protrusions to discharge sweat or odor inside the shoes.

A width of the discharge passage may be 0.5 cm to 3 cm.

Protrusion heights of different protrusions located at the same level may be the same or different.

When the protrusion heights of the different protrusions located at the same level are different from each other, the protrusion height may increase from the edge portion of the cover toward the center.

Extending lengths of two adjacent protrusions may be the same or different.

The shoes according to the above feature may further include a shape support portion located between an edge portion of the cover and an edge portion of the second body portion adjacent to the edge portion of the cover and having a thickness greater than those of the cover and the second body portion.

The shape support portion may include: a main body located between the edge portion of the second body portion and the edge portion of the cover adjacent to each other and facing each other; and a support protrusion protruding from an inner surface of the main body.

A width of the main body may be different depending on a position.

The width of the main body may increase in a direction from an upper end of the main body toward a crutch portion in which a talus bone of the wearer's foot is located and in a direction from a lower end of the main body to the crutch portion of the wearer.

A thickness of the support protrusion may increase from an edge portion connected to the second body portion toward the cover.

The shape support portion may further include an extension portion extending in a direction intersecting the support protrusion from a lower end of the support protrusion.

A height of an outer surface of the extension portion may be higher than a height of outer surfaces of the adjacent first and second body portions.

The shoes according to the above feature may further include an arrest protrusion located on a rear outer surface of the second body portion.

The shoes according to the above feature may further include: an outer shoe surrounding the shoes; and a protective member located between the outer shoe and the shoes and covering the front foot portion of the shoes.

According to another aspect of the present disclosure, there is provided shoes including: a first body portion in which a portion of a front foot portion of a wearer is positioned; a second body portion connected to the first body portion and in which the other remaining portion of the front foot portion, a middle foot portion, and a rear foot portion of the wearer are positioned; a cover seamlessly connected to the second body portion and protruding in an outward direction from both edge portions; at least one protrusion protruding from an inner surface of the cover and extending in a direction in which the second body portion extends, wherein a protruding thickness of each protrusion decreases from an upper portion toward the first body portion.

When the protrusion is provided in plurality, the plurality of protrusions may be spaced apart from each other across the inner surface of the cover.

The shoes according to the above feature may further include a discharge passage located between two adjacent protrusions to discharge sweat or odor inside the shoes.

A width of the discharge passage may be 0.5 cm to 3 cm.

Protrusion heights of different protrusions located at the same level may be the same or different.

When the protrusion heights of the different protrusions located at the same level are different from each other, the protrusion height may increase from the edge portion of the cover toward the center.

Extending lengths of two adjacent protrusions may be the same or different.

The shoes according to the above feature may further include a shape support portion located between an edge portion of the cover and an edge portion of the second body portion adjacent to the edge portion of the cover and having a thickness greater than those of the cover and the second body portion.

The shape support portion may include: a main body located between the edge portion of the second body portion and the edge portion of the cover adjacent to each other and facing each other; and a support protrusion protruding from an inner surface of the main body.

A width of the main body may be different depending on a position.

The width of the main body may increase in a direction from an upper end of the main body toward a crutch portion in which a talus bone of the wearer's foot is located and in a direction from a lower end of the main body to the crutch portion of the wearer.

A thickness of the support protrusion may increase from an edge portion connected to the second body portion toward the cover.

The shape support portion may further include an extension portion extending in a direction intersecting the support protrusion from a lower end of the support protrusion.

A height of an outer surface of the extension portion may be higher than a height of outer surfaces of the adjacent first and second body portions.

The shoes according to the above feature may further include an arrest protrusion located on a rear outer surface of the second body portion.

The shoes according to the above feature may further include: an outer shoe surrounding the shoes; and a protective member located between the outer shoe and the shoes and covering the front foot portion of the shoes.

Advantageous Effects

According to embodiments of the present disclosure, since the air passage is located inside the shoes, sweat, heat, or odor occurring in the shoes may be quickly and effectively discharged, thereby improving a user's foot health and providing an excellent fit of the shoes.

In addition, since the foot insertion space into which the foot is inserted in the shoes is limited by the foot support portion located in the extending direction of the air passage portion in which the air passage is formed, the foot insertion space is not increased in the air passage portion protruding outward from a middle portion of the front of the shoes. Accordingly, a phenomenon that the shoes become loose when the user wears the shoes is prevented, thereby improving wearing sensation of the shoes.

In addition, since the air passage portion extends from the body of the shoes and is formed integrally, the shoes are easily and smoothly bent according to a user's foot motion without being interfered by the air passage portion, thereby improving convenience of the shoes and wearing sensation of the shoes due to the weight reduction of the shoes.

In addition, since an insole for discharging sweat occurring in the shoes toward the bottom portion or collecting sweat is provided, the wearing sensation and hygiene of the shoes are improved and foot health is also improved.

Since the air passage portion extends from the body of the shoes and is formed integrally, the shoes are easily and smoothly bent according to a user's foot motion without being interfered by the air passage portion. Therefore, the air passage portion does not cause inconvenience of using the shoes.

Since the protruding thickness of the protrusion located on the inner surface of the air passage portion decreases toward the first body portion, pain or injury caused by the protrusion contacting the instep is prevented.

In addition, since the shape of the shoes is easily and stably maintained by the shape support portion located between the second body portion and the air passage portion, the shoes are located very safely although the extending length of the second body portion is increased. Therefore, wearer convenience may be improved when putting on and taking off shoes.

BEST MODES

Figure 1:
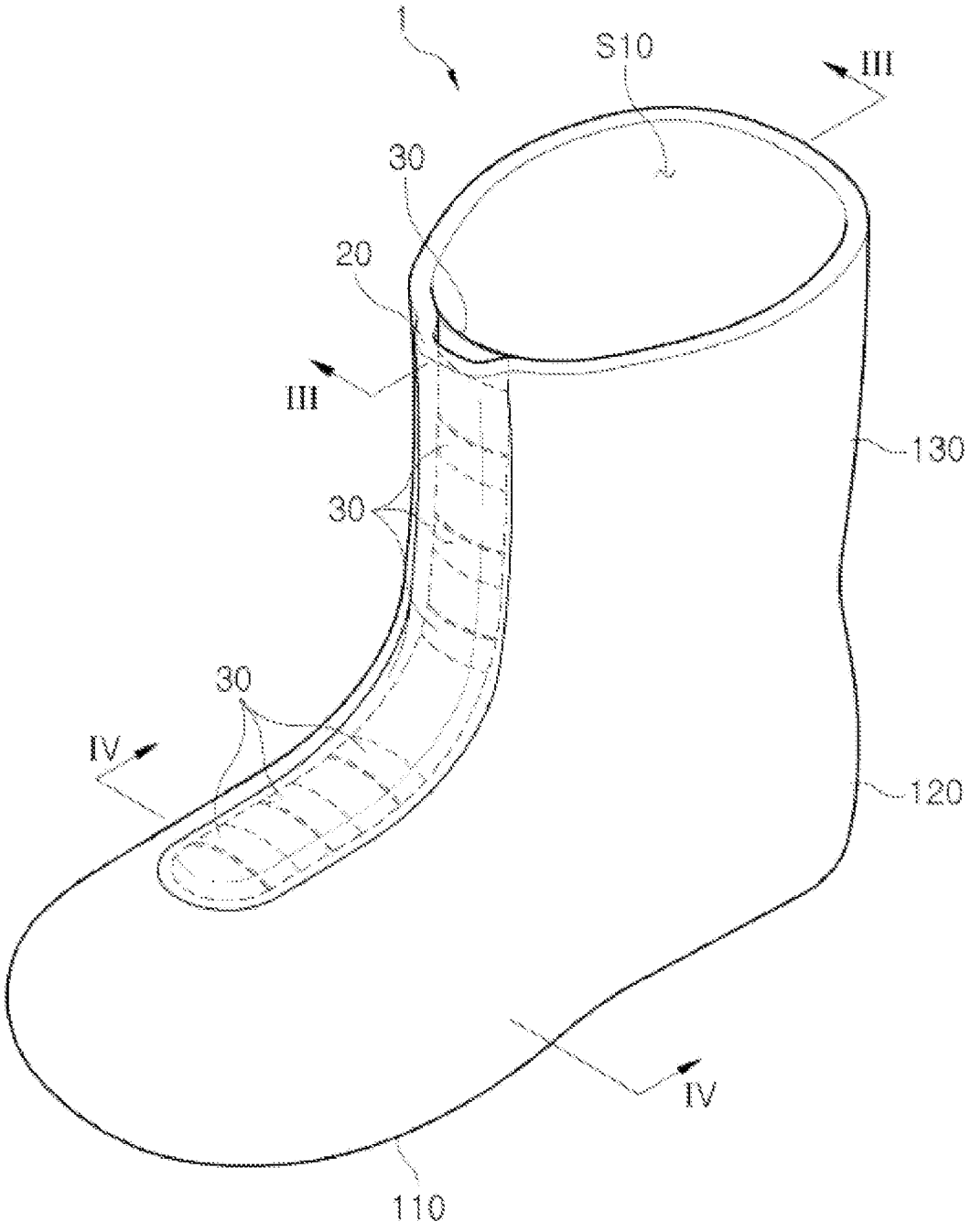
FIG. 1 is a perspective view of shoes according to an embodiment of the present disclosure.

Hereinafter, embodiments of the present disclosure will be described in detail with reference to the accompanying drawings. In describing the present disclosure, if it is determined that a detailed description of known functions and components associated with the present disclosure unnecessarily obscure the gist of the present disclosure, the detailed description thereof will be omitted. The terms used henceforth are used to appropriately express the embodiments of the present disclosure and may be altered according to a person of a related field or conventional practice. Therefore, the terms should be defined on the basis of the entire content of this specification.

Technical terms used in the present specification are used only in order to describe specific exemplary embodiments rather than limiting the present disclosure. The terms of a singular form may include plural forms unless referred to the contrary. It will be further understood that the terms "comprise" and/or "comprising," when used herein, specify the presence of stated features, integers, steps, operations, elements, and/or components, but do not preclude the presence or addition of one or more other features, regions, integers, steps, operations, elements, components, and/or groups thereof.

Hereinafter, shoes according to an embodiment of the present disclosure will be described in detail with reference to the accompanying drawings.

First, shoes according to an embodiment of the present disclosure will be described with reference to FIGS. 1 to 5.

Shoes 1 according to an embodiment of the present disclosure includes a body 10, an air passage portion 20 protruding from a front of the body 10 in an outward direction, and a plurality of foot support portions 30 attached to the air passage portion 20.

The body 10 is a portion, into which a foot of a user 200 is inserted, worn on the foot of the user 200 and includes a bottom portion 110, an instep portion 120 connected to the bottom portion 110, and an ankle portion 130 connected to the instep portion 120.

The bottom portion 110 is a portion in which a sole of the user 200 is located, and contacts the sole of the user when the user wears the shoes.

The instep portion 120 is a portion covering an instep of the user 200, and the foot of the user 200 is inserted into a space surrounded by the bottom portion 110 and the instep portion 120 to wear shoes.

The ankle portion 130 is a portion that is seamlessly connected to an end of the instep portion 120 and protrudes toward a body of the user 200. According to a protruding length of the ankle portion 130, a portion of the user's leg, as well as the user's ankle, may be worn in the shoes 1.

Here, the ankle portion 130 may be omitted or the protruding length of the ankle portion 130 may be adjusted, and various types of shoes may be manufactured by omitting the ankle portion 130 or adjusting the protruding length.

The air passage portion 20 is a convex portion protruding outwardly with a predetermined width W20 from a middle portion of the front of the instep portion 120 and the ankle portion 130.

The air passage portion 20 may be located in a straight line along the ankle portion 130 from the instep portion 120 of the body 10.

Here, the air passage portion 20 extends seamlessly from an upper portion of a front nose portion 121 of the shoes 1 located in a connection portion of the bottom portion 110 and the ankle portion 120 in which toes are mainly positioned, i.e., from a portion (i.e., an instep start portion) 122 of the instep portion 120 corresponding to a portion in which the instep starts to an end portion of the ankle portion 130 as a straight line. In this example, the front nose portion 121 forms a portion of the instep portion 120.

Here, the width W20 of the air passage portion 20 may be equal regardless of height and may be a size with which heat or sweat occurring in the shoes 1 is efficiently discharged without bringing about discomfort of the user who wears the shoes 1 and spoiling the beauty. For example, the width W20 of the air passage portion 20 may ranged from 0.5 cm to 2 cm.

Figure 2:
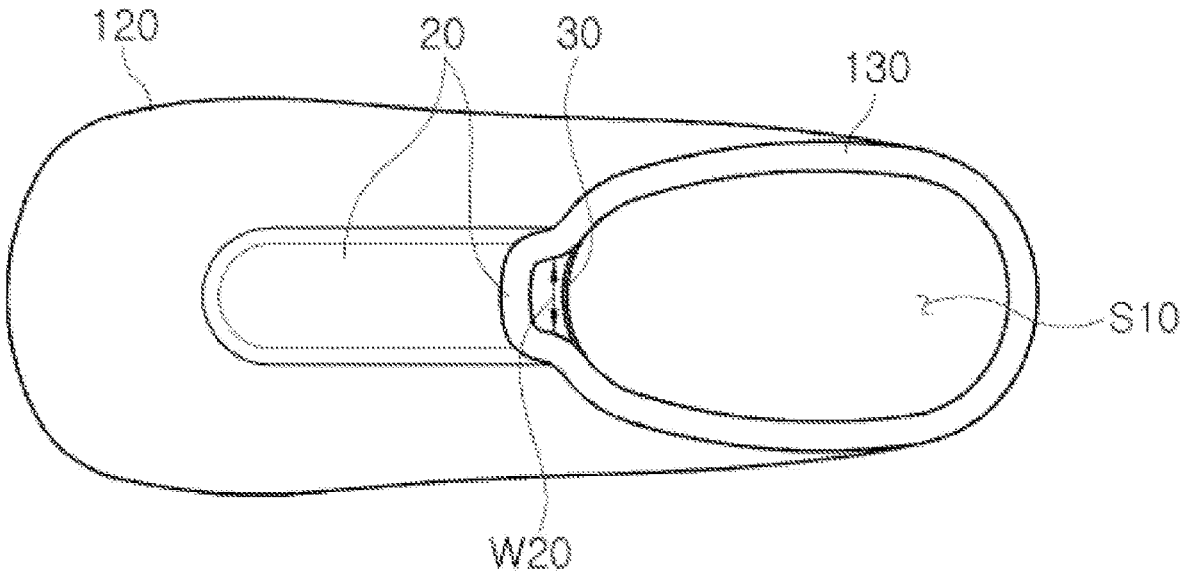
FIG. 2 is a plan view of the shoes shown in FIG. 1.

The protrusion height H20 of the air passage portion 20 may be different from each other in a width direction at the same level. That is, since planar shapes of an inner surface and an outer surface of the air passage portion 20 are formed as curved surfaces rather than an angular shape as shown in FIG. 2, a protrusion height H20 at a middle portion of the air passage portion 20 may be greater than a protrusion height H20 at an edge portion thereof at the same level.

In this example, the protrusion height H20 may be a shortest distance from a virtual line L1 extending from the instep start portion 122 toward the ankle portion 130 and extending to be spaced apart from an inner surface of the adjacent air passage portion 20 by the same distance to the inner surface of the air passage portion 20, and the width W20 may be a shortest distance between both sides of the inner surface of the air passage portion 20 facing each other on the mutually opposite sides in the width direction.

Figure 3:
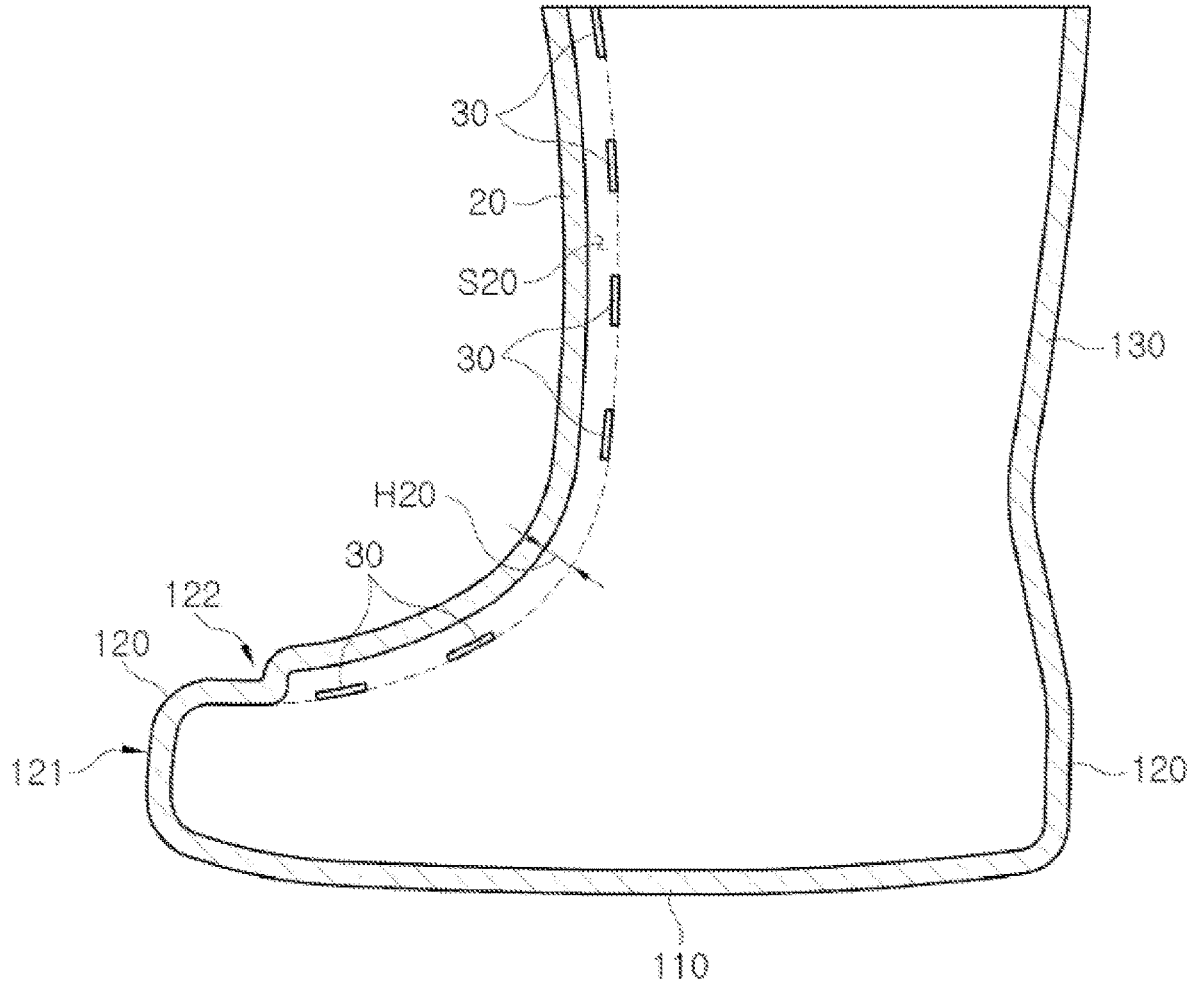
FIG. 3 is a cross-sectional view taken along line III-III of FIG. 1.
Figure 4:
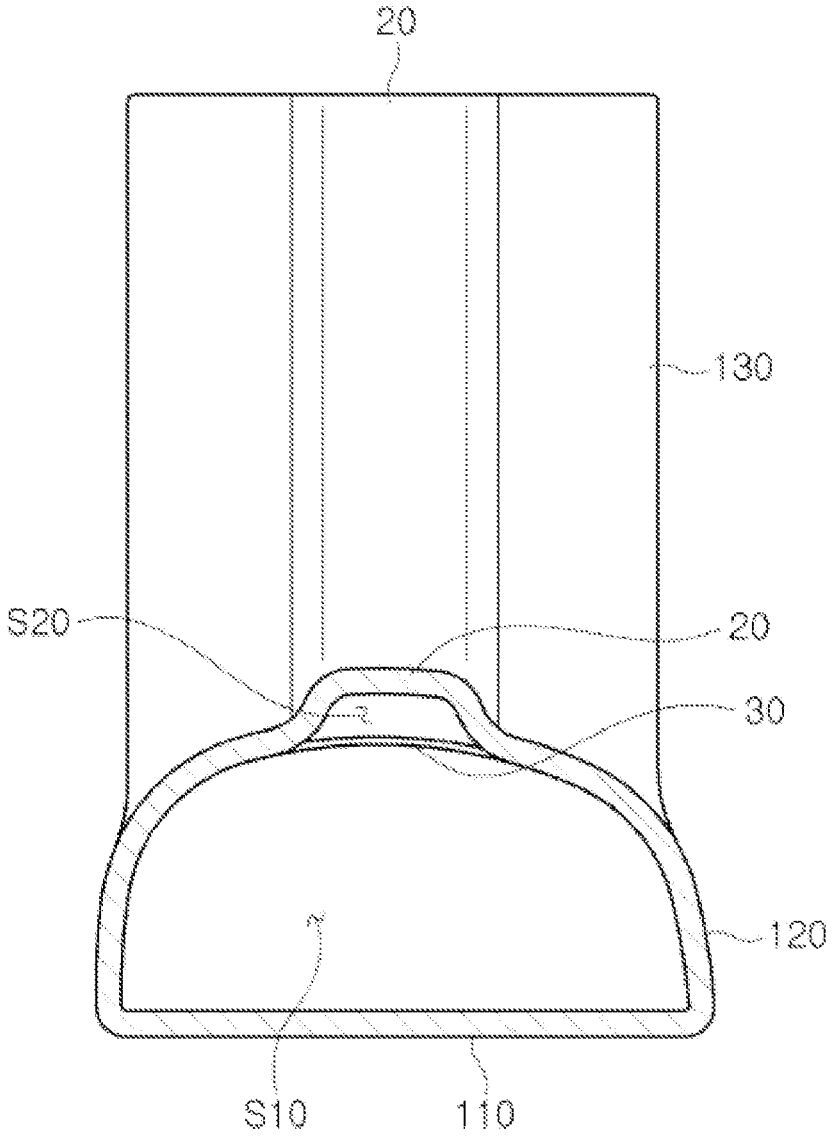
FIG. 4 is a cross-sectional view taken along line IV-IV in FIG. 1.
Figure 5:
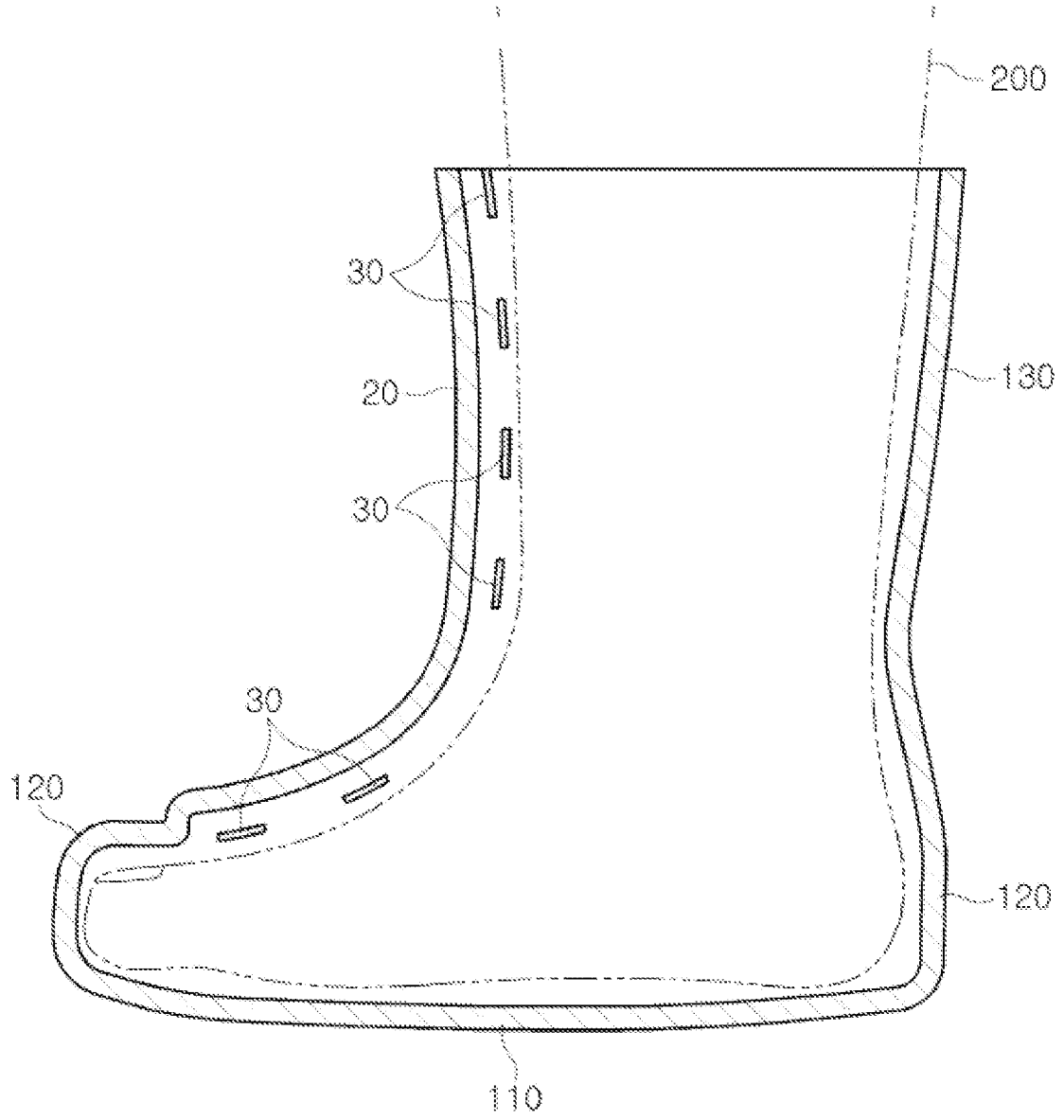
FIG. 5 is a cross-sectional view taken along line III-III of FIG. 1 when a user wears shoes according to an embodiment of the present disclosure.

Therefore, as shown in FIG. 3, the air passage portion 20 protrudes with the predetermined width W20 from the middle portion of the front of the body 10 in an outward direction and protrudes to an end portion of the body 10 in an extending direction of the body 10 which extends toward the body of the user 20.

The plurality of foot support portions 30 are portions for safely and conveniently supporting the foot and leg portions of the user 20 inserted in the shoes 1. The plurality of foot support portions 30 are located between both sides of the inner surface of the air passage portion 20 and arranged to be spaced apart from each other in the extending direction of the air passage portion 20 (i.e., in the direction toward the ankle portion 130 from the instep portion 120, which is the opposite direction of the width direction).

The foot support portion 30 may have the same shape such as a bar shape or a band shape and have the same size, but at least one of the shape and size of the foot support portion 30 may be different depending on a position thereof. In a case in which at least one of the shape and size is different depending on a position, the shape and the size of the foot support portion 30 may be determined according to a body shape of the user in contact with the foot support portion 30.

Therefore, one side of the foot support portion 30 is connected to one side of the inner surface of the air passage portion 20, and the other side of the foot support portion 30 is connected to the other side of the inner surface of the air passage portion 20, and thus, each foot support portion 30 is located side by side in the width direction of the air passage portion 20.

Here, since two adjacent foot support portions 30 are spaced apart at the same interval, the plurality of foot support portions 30 may be spaced apart at regular intervals in the extending direction of the air passage portion 20.

However, in an alternative example, a distance between two adjacent foot support portions 30 may be different. Here, as shown in FIG. 1, instead of being uniformly located along the extending direction of the air passage portion 20, the plurality of foot support portions 30 may be located only at predetermined specific positions.

For example, the plurality of foot support portions 30 may be located to be spaced apart from each other at a predetermined interval in a portion of the air passage portion 20 corresponding to the user's leg portion of the air passage portion 20 corresponding to an ankle portion of the user, and may not be located in a portion of the air passage portion 20 corresponding to the ankle portion in which bending of foot frequently occurs. Here, a distance at the portion in which the foot support portion 30 is located may be the same.

In this manner, when the plurality of foot support portions 30 are located only at predetermined specific positions of the air passage portion 20, the plurality of foot support portions 30 may not be located in a portion in which the bending motion of the shoes 1 is mainly made in the air passage portion 20, that is, a portion corresponding to the ankle portion as described above to minimize discomfort of the foot located in the shoes 1.

In this manner, when a plurality of foot support portions 30 are located in a specific position, activity of the shoes 1 may be improved and damage to the skin due to contact between the foot support portions 30 and the skin when the bending motion of the shoes 1 is made with respect to the ankle portion may be prevented.

In this manner, as the plurality of foot support portions 30 are located in the extending direction of the air passage portion 20, an open portion of the air passage portion 20 in which each foot support portion 30 is located may be blocked by the corresponding foot support portion 30 so as to be separated from a space surrounded by the instep portion 120 and the ankle portion 130.

Accordingly, a space in the shoes 1 in which lower and side portions are surrounded by the bottom portion 110, the instep portion 120, the ankle portion 130 and the air passage portion 20 of the body 10 and an upper portion is open may be divided into a space S10 surrounded by the bottom portion 110, the instep portion 120, the ankle portion 130, and the plurality of foot support portions 30 and a space S20 surrounded by the air passage portion 20 and the plurality of foot support portions 30.

Here, the space S10 is a foot insertion space into which the user's foot is inserted, and the space S20 is an air passage through which air flows between the inside and the outside of the shoes 1, and thus, the air passage 20 is formed between the air passage portion 20 and the foot support portion 30.

Here, the air passage 20 is separated from the foot insertion space S10 of the body 10 in which the user's foot is inserted in the portion in which the foot support portion 30 is located, but in a portion in which the foot support portion 30 is not located, the air passage 20 communicates with the foot insertion space S10, and thus, the foot insertion space S10 communicates with the outside through the air passage 20.

Therefore, due to the formation of the air passage 20, air flows between the inside and the outside of the shoes 1 so that heat or sweat that occurs in the shoes 1 may be quickly discharged to the outside through the air passage 20, thus making the environment inside the shoes 1 comfortable.

In addition, as the plurality of foot support portions 30 are located to traverse the air passage portion 20 protruding outward from the body 10 of the shoes 1 in the width direction, the foot insertion space S10 in which the foot of the user 200 is substantially inserted and located is a space surrounded by a main body 10 and the plurality of foot support portions 30 as described above, as shown in FIG. 5.

Therefore, when the foot is inserted into the foot insertion space S10, the instep and shin of the user 200 located in the front portion of the shoes 1 are limited by the plurality of foot support portions 30, and thus, a problem that the foot insertion space S10 increases due to the air passage portion 20 protruding to the outer portion of the body 10 is prevented.

Therefore, despite the formation of the air passage portion 20, the foot insertion space S10 is not increased by the air passage portion 20 and the foot insertion space S10 is determined to be suitable to the size of the foot and leg of the user 200, thereby preventing a problem that wearing sensation of the shoes 1 is degraded due to the air passage portion 20.

In the shoes 1 of this example, the body 10, the air passage portion 20, and the foot support portion 30 may all be formed of the same material, and may be formed of a material such as natural rubber, synthetic rubber, or synthetic resin.

For example, the body 10, the air passage portion 20, and the foot support portion 30 may be formed of polyethylene (PE) which is non-toxic, has excellent chemical resistance, and has excellent insulation, polyvinyl chloride (PVC) which has excellent light resistance, chemical resistance, and electrical insulation, a thermoplastic rubber which is non-adhesive and non-oil and has high insulation, thermoplastic rubber (TPR) which has cold resistance and is resistant to acids or alkalis, styrene butadiene styrene (SBS), styrene ethylene butylene styrene (SEBS), or ethylene propylene diene M-class (EPDM) which has excellent heat resistance and flexibility at low temperatures.

In addition, the body 10, the air passage portion 20, and the foot support portion 30 may be formed of styrene ethylene propylene styrene (SEPS), SEEBS, styrene-ethylene-ethylene/propylene-styrene (SEEPS), ethylene vinyl acetate (EVA), thermoplastic polyurethane (TPU), polyurethane (PU), polystyrene (PS), polypropylene (PP), TPO, rubber such as thermoplastic cured rubber (TPV) or a foam resin.

In an alternative example, the bottom portion 120 of the body 10 may be formed of a material different from that of the other portions 120 and 130 of the body 10, and here, the bottom portion 120, the instep portion 120, and the ankle portion 130 may be formed of a material such as natural rubber, synthetic rubber, or synthetic resin.

In another example, the body 10 and the air passage portion 20 are formed of the same material, but a portion of the foot support portion 30 may be formed of a material different from the body 10 and the air passage portion 20. Here, the body 10 and the air passage portion 20 are formed of a material such as natural rubber, synthetic rubber, or synthetic resin, whereas a portion of the foot support portion 30 adjacent to the user's body and in contact with the skin is provided with fiber or the like added thereto and other portions of the foot support portion 30 may be formed of the same material as the body 10.

In this example, a plurality of foot support portions 30 are provided, only a single foot support portion 30 may also be provided.

Next, with reference to FIGS. 6 to 16, shoes 1*a*-1*f* according to other embodiments of the present disclosure will be described.

In this embodiment, compared to the shoes 1 shown in FIGS. 1 to 5, components having the same structure and performing the same function will be given the same reference numerals as those of the shoes 1 illustrated in FIGS. 1 to 5 and a detailed description thereof will be omitted.

First, shoes 1*a* of an example according to another embodiment of the present disclosure will be described with reference to FIGS. 6 to 7B.

Compared with the shoes 1 shown in FIGS. 1 to 5, the shoes 1*a* according to another embodiment of the present disclosure further includes an insole 50 located at the bottom portion 110 of the body 10.

Figure 6:
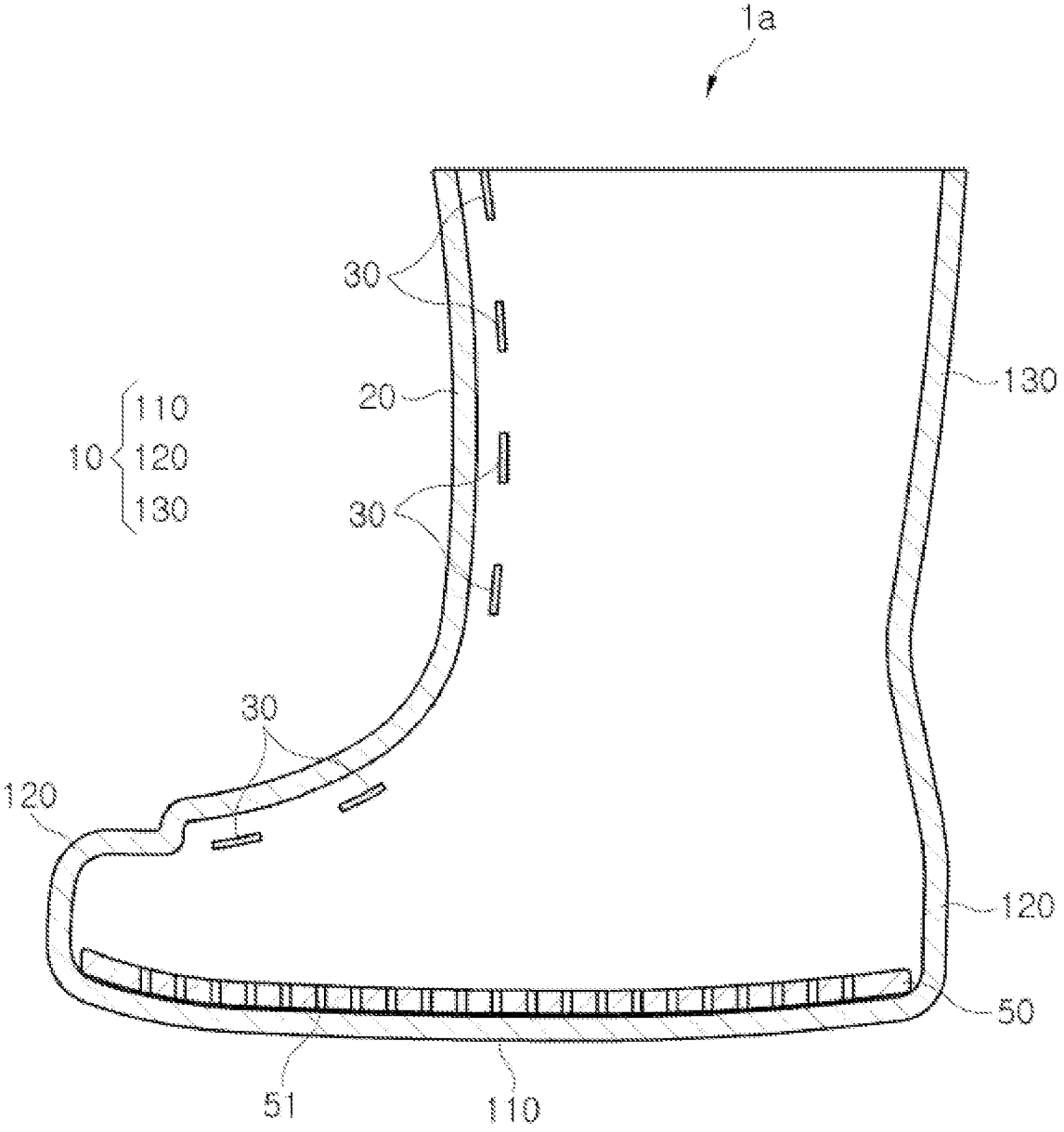
FIG. 6 is a cross-sectional view taken along line III-III of FIG. 1, illustrating an example of shoes according to another embodiment of the present disclosure.

Therefore, as shown in FIG. 6, the shoes 1*a* in this example includes a body 10 including a bottom portion 110, an instep portion 120, and an ankle portion 130, an air passage portion 20 located to protrude outward from a middle portion of a front of the body 10, a plurality of foot support portions 30 located in an extending direction of the air passage portion 20, and the insole 50 located in contact with the bottom portion 110.

The insole 50 has substantially the same shape as a shape of the bottom portion 110 and is located in the bottom portion 110 surrounding the foot insertion space S10 of the shoes 1*a*, so the insole 50 has a size smaller than a size of the bottom portion 110.

Figure 7A:
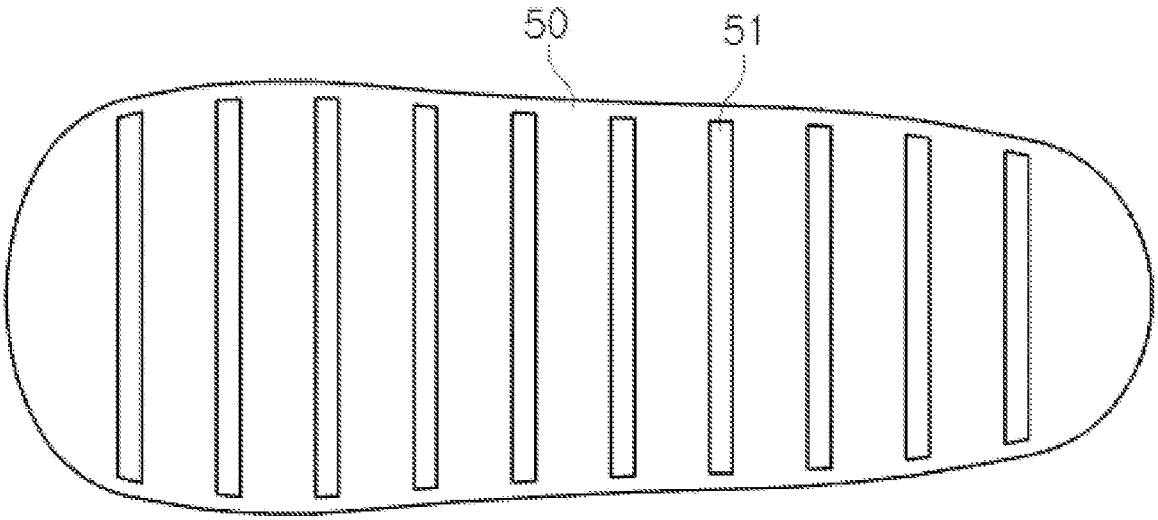
FIGS. 7A and 7B are plan views showing various examples of an insole shown in FIG. 6, respectively.
Figure 7B:
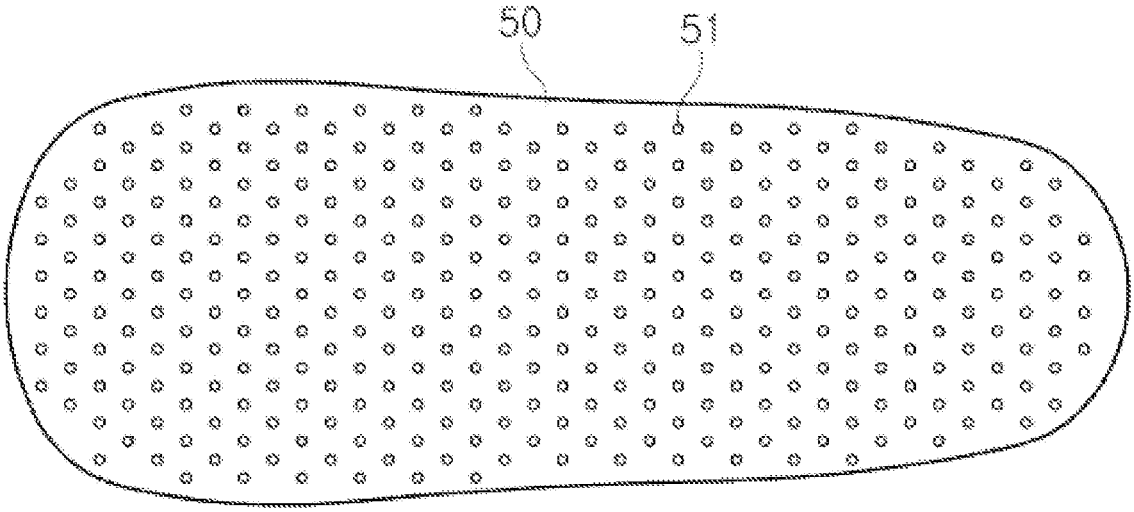

In this example, the insole 50 may include a moisture discharge portion 51 as shown in FIGS. 7A and 7B.

Here, a moisture discharge portion 51 may be a hole that completely penetrates the insole 50 in a thickness direction of the insole 50 or a recess formed on the surface of the insole 50, without completely penetrating the insole 50.

A shape of the moisture discharge portion 51 formed on the insole 50 may have, for example, a linear shape as shown in FIG. 7A or a circular shape as shown in FIG. 7B, but is not limited thereto. That is, the moisture discharge portion 51 may have various other shapes such as a polygonal shape such as a triangular or quadrangular shape, an elliptical shape, and a wavy shape, in addition to the linear or circular shapes. In addition, the moisture discharge portions 51 may have the same shape and size or may have different sizes and shapes.

In addition, since the insole 50 of the present example is detachably located on the bottom portion 110, it may be located in the foot insertion space S10 or removed from the foot insertion space S10 according to the needs of the user. Therefore, the user may separate the insole 50 from the shoes 1*a* and wash it separately.

The insole 50 may be formed of a material having elasticity such as natural rubber, synthetic rubber, or synthetic resin, and fiber may be additionally attached to a surface thereof in contact with the sole of the user.

When the insole 50 is additionally provided in the shoes 1*a*, a magnitude of an impact applied to the feet of the user 200 wearing the shoes 1*a* is significantly reduced and a foot protective function is further strengthened, so that user satisfaction is improved.

Moreover, sweat discharged from the sole of the foot by the moisture discharge portion 51 formed in the insole 50 is discharged toward the bottom portion 110 through the moisture discharge portion 51 or gather in the recess formed in the moisture discharge portion 51. Accordingly, the wearing sensation of the shoes 1*a* is improved and the foot is protected from sweat.

In addition, when the moisture discharge portion 51 is formed in a hole shape, sweat discharged to the bottom portion 110 is vaporized and quickly discharged to the outside through the air passage portion 20 and heat generated from the user's feet is also quickly discharged to the outside through the moisture discharge portion 51 and the air passage portion 20.

In this manner, when the shoes 1*a* additionally includes the insole 50, a corresponding inner surface (i.e., an upper surface) of the bottom portion 110 in contact with the insole 50 in the shoes 1*a* shown in FIG. 6 has a flat surface.

Figure 8:
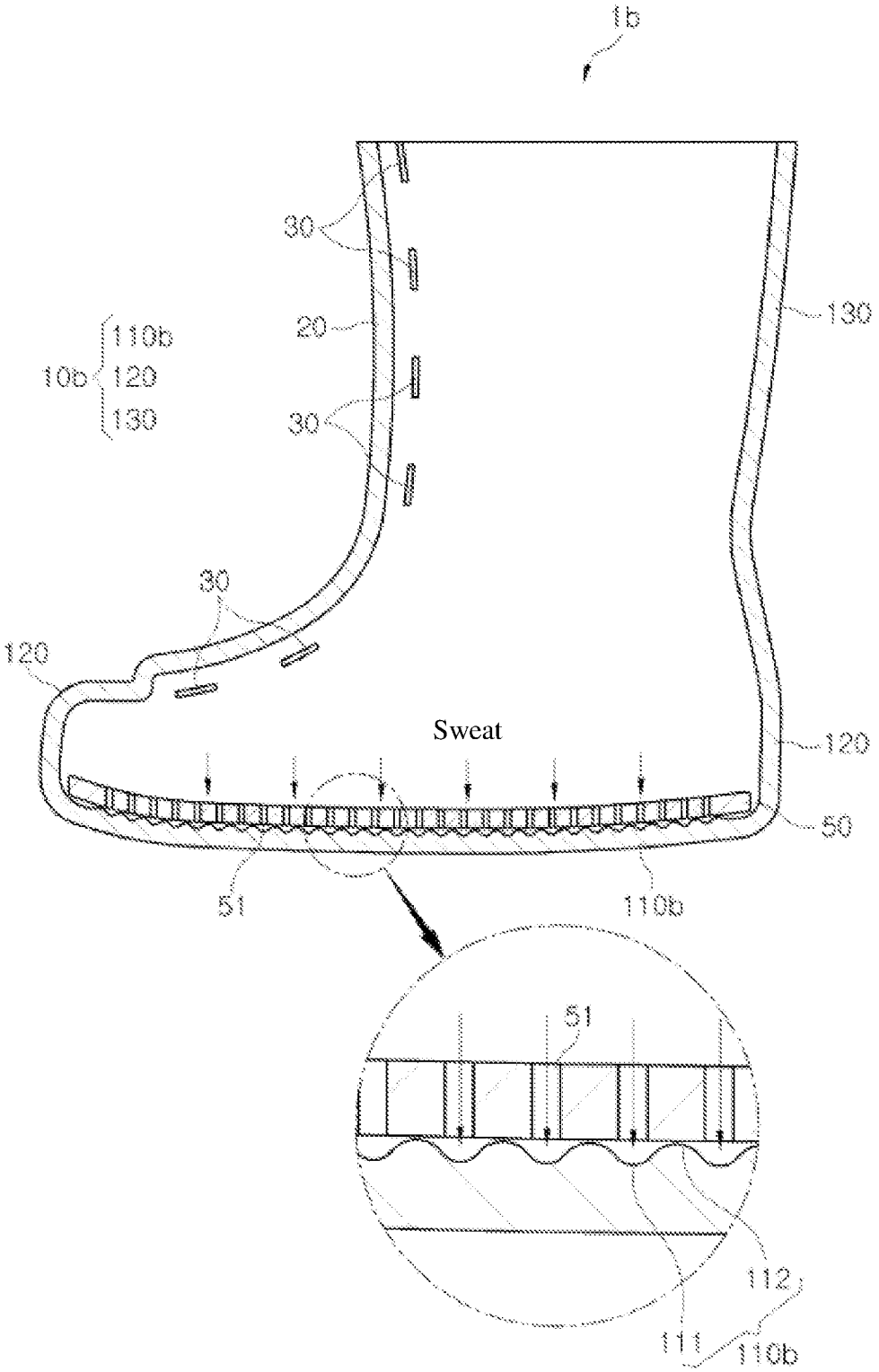
FIG. 8 is a cross-sectional view taken along line III-III of FIG. 1, illustrating another example of shoes according to another embodiment of the present disclosure.
Figure 9:
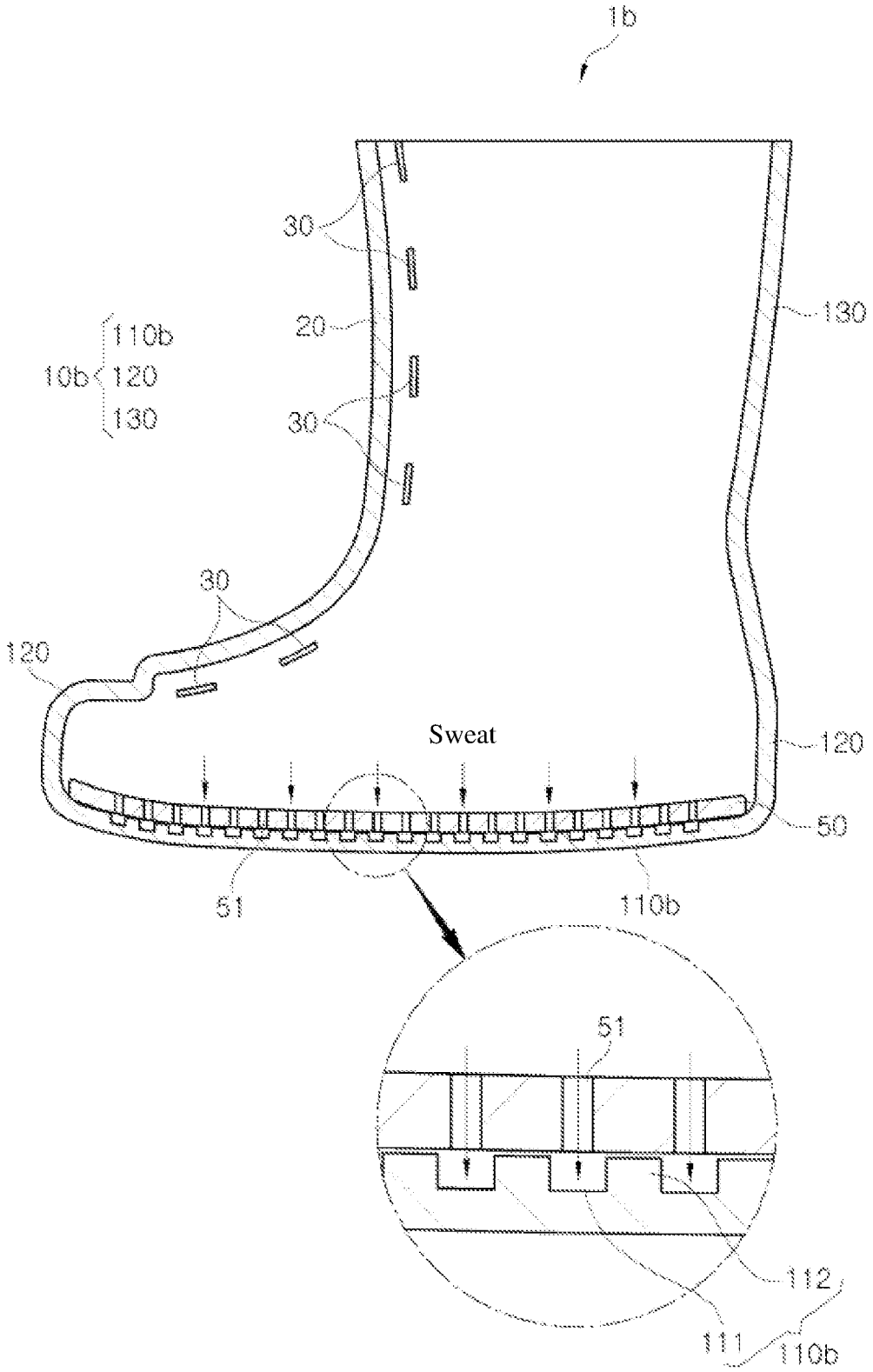
FIG. 9 is a cross-sectional view taken along line III-III of FIG. 1, illustrating another example of shoes according to another embodiment of the present disclosure.

However, in shoes 1*b* of another example according to the present embodiment shown in FIGS. 8 and 9, an inner surface of a bottom portion 110*b* of a body 10*b* is not a flat surface but an uneven surface, and except for this, the shoes 1*b* shown in FIGS. 8 and 9 has the same structure as the shoes 1*a* shown in FIG. 6. The moisture discharge portion 51 formed in the insole 50 of this example is configured as a hole penetrating the insole 50 in a thickness direction.

In addition, when comparing the shoes 1*b* shown in FIGS. 8 and 9 with each other, the shapes of the depressions and protrusions formed on inner surfaces of the bottom portions 110*b* of the shoes 1*b* are different from each other.

That is, in the case of FIG. 8, a concave portion 111 and a convex portion 112 formed on the inner surface of the bottom portion 110*b* have a curved surface such as a semicircle, whereas in the case of FIG. 9, a concave portion 111 and a convex portion 112 formed on the inner surface of the bottom portion 110*b* have an angled surface such as a square.

Figure 10A:
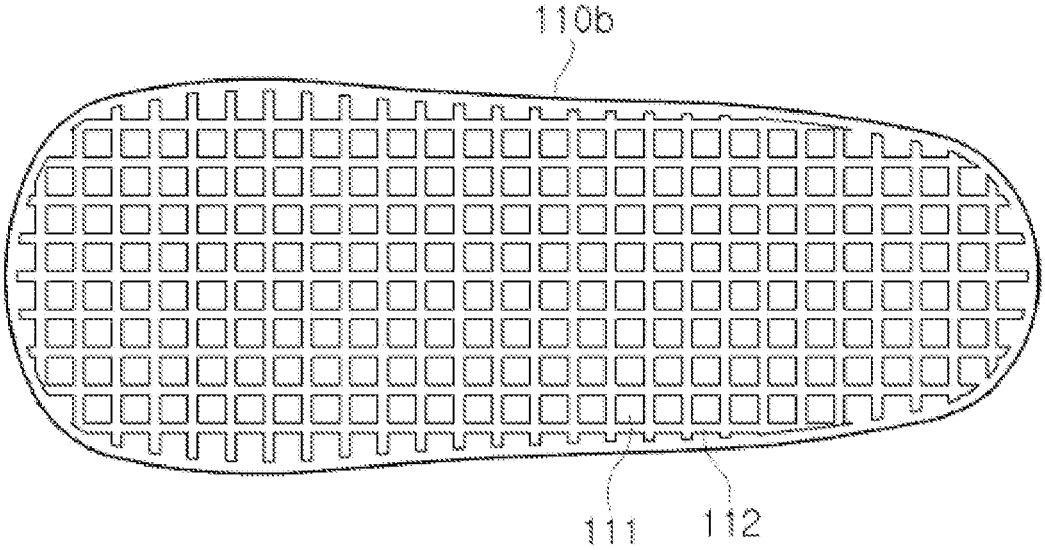
FIGS. 10A and 10B are plan views illustrating various examples of a bottom portion of the shoes illustrated in FIG. 9, respectively.
Figure 10B:
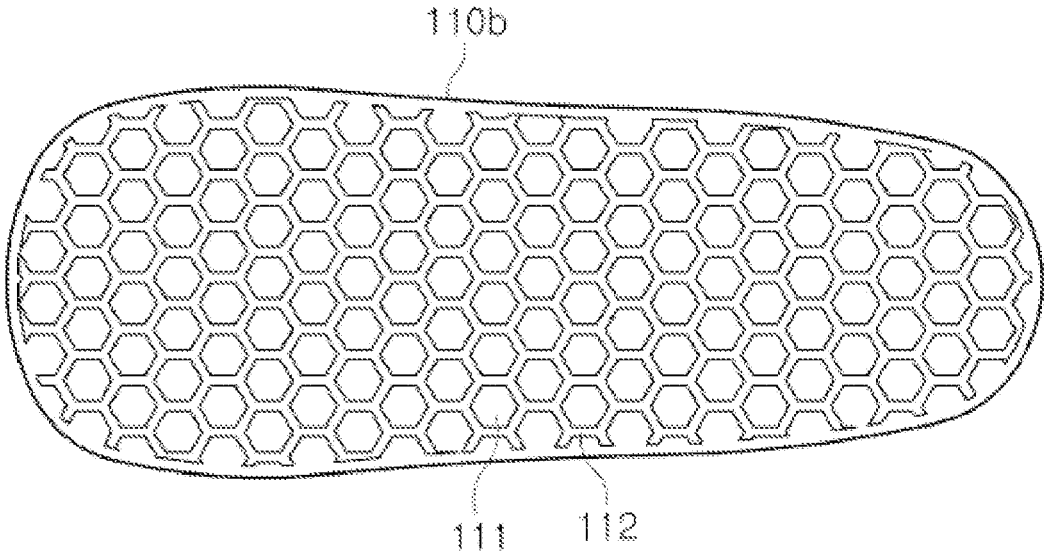

Here, an example of the uneven surface formed on the inner surface of the bottom portion 110*b* of the shoes 1*b* of FIG. 9 may be formed in a grid shape to form a quadrangular concave portion 111 as shown in FIG. 10A or may be formed in a honeycomb shape to form a hexagonal concave portion 111 as shown in FIG. 10B.

However, the shapes of the depressions and protrusions of the bottom portion 110*b* illustrated in FIGS. 8 and 9 are an example, and the bottom portion 110*b* may have various other shapes of depressions and protrusions.

Here, the concave portion 111 formed on the bottom portion 110*b* is formed at a position facing the moisture discharge portion 51.

As described above, since the inner surface of the bottom portion 110*b* in contact with the insole 50 is formed as the uneven surface having the concave portion 111 and the convex portion 112, the insole 50 is in contact with the convex portion 112 of the bottom portion 110*b* but is not in contact with the concave portion 111, and thus, an empty space exists between the bottom portion 110*b* and the insole 50, that is, between the moisture discharge portion 51 and the concave portion 111.

In general, the bottom portion of the shoes in contact with a floor has a structure in which a toe portion, a metatarsal bone, and a heel portion are in close contact with the floor along a foot sole of the user 200 and an arch portion between the metatarsal bone and the heel is not in contact with the floor.

In addition, the toes, metatarsal bones and heels in contact with the floor with the shoes interposed therebetween do not come into contact with the floor at the same time but contact the floor in turn according to a walking type or exercise process of the user 200.

Therefore, since the bottom portion 110*b* of the shoes 1*b* partially and alternately contacts and does not contact the floor, moisture such as sweat gathers in the concave portion 111 of the bottom portion 110 through the moisture discharge portion 51. The accumulated moisture is vaporized over time and moves along the empty space between the insole 50 not in contact with the floor and the bottom portion 110*b* so as to be discharged to the outside through the air passage 20.

Accordingly, moisture that has passed through the moisture discharge portion 51 of the insole 50 is efficiently collected in the concave portion 111 of the uneven surface by the bottom portion 110*b*, which is an uneven surface, and moisture is efficiently evaporated through the space formed between the insole 50 and the bottom portion 110*b*, thereby further improving a sweat discharge effect.

In addition, sweat discharged from the insole 50 toward the bottom portion 110*b* is located in the empty space between the moisture discharge portion 51 and the concave portion 111, so that sweat discharged toward the bottom portion 110*b* is prevented from being introduced toward the insole 50.

In addition, as already described above, since there is a compression-free space between the insole 50 and the bottom portion 110*b* by the flat surface of the bottom portion 110*b*, the user 200 may easily remove the insole 50 from the shoes 1*b* without damage to the insole such as tearing, so that life of the insole 50 is extended.

Figure 11:
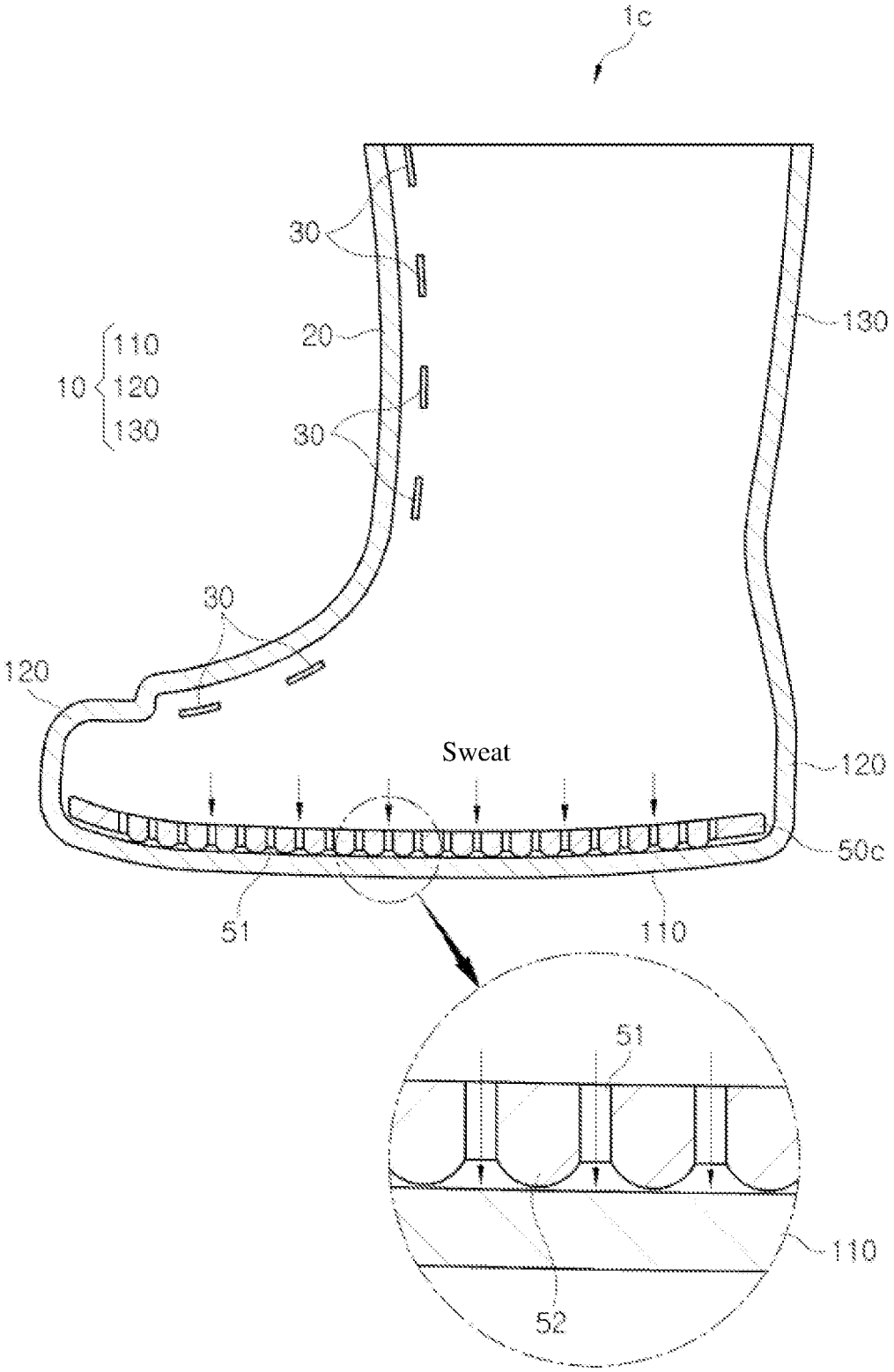
FIG. 11 is a cross-sectional view taken along line III-III of FIG. 1, illustrating another example of shoes according to another embodiment of the present disclosure.

Unlike the shoes 1*b* illustrated in FIGS. 8 and 9, in shoes 1*c* of another example according to this embodiment shown in FIG. 11, an inner surface of the bottom portion 110 of the body 10 in contact with an insole 50*c* is a flat surface like that of FIG. 6, while a plurality of bottom protrusions 52 are attached to a corresponding surface (i.e., lower surface) of the insole 50*c* in contact with the bottom portion 110. Therefore, due to the plurality of bottom protrusions 52, the lower surface of the insole 50*c* has an uneven surface.

Here, the bottom protrusion 52 is located between adjacent moisture discharge portions 51 formed in a hole shape. A size, location, and shape of the bottom protrusion 52 may be determined according to a size, location, and shape of the moisture discharge portion 51.

As such, the shoes 1*c* of FIG. 11 have the same structure as the shoes 1*a* of FIG. 6 except that a plurality of bottom protrusions 52 is attached to the lower surface of the insole 50*c*.

Due to the plurality of bottom protrusions 52, the inner surface of the bottom portion 110 is mostly in contact with the bottom protrusion 52 of the corresponding insole 50*c*, and thus, an empty space is formed between the insole 50*c* and the bottom portion 110 (i.e., between the moisture discharge portion 51 and the inner surface of the bottom portion 110). Therefore, as already described above, an effect of discharging sweat discharged through the moisture discharge portion 51 may be significantly improved due to the empty space formed between the insole 50*c* and the bottom portion 110, and a phenomenon in which sweat discharged toward the bottom portion 110 flows into the insole 50*c* again is prevented. In addition, since there is a portion of the insole 50*c* which is not compressed to the bottom portion 110, life of the insole 50*c* is also increased.

In the example shown in FIGS. 9 to 11, one of the inner surface of the bottom portion 110*b* and the lower surface of the insole 50*c* has an uneven surface, but the present disclosure is not limited thereto and both the inner surface of the bottom portion 110*b* and the lower surface of the insole 50*c* may have an uneven surface. In this case, the convex portions respectively formed on the inner surface of the bottom portion 110*b* and the lower surface of the insole 50*c* are located to correspond to each other so that an empty space is formed between the moisture discharge portion 51 and the concave portion in the form of holes formed in the insoles 50 and 50*c*.

Hereinafter, shoes 1*d* according to another embodiment of the present disclosure will be described with reference to FIGS. 12 to 14.

Figure 12:
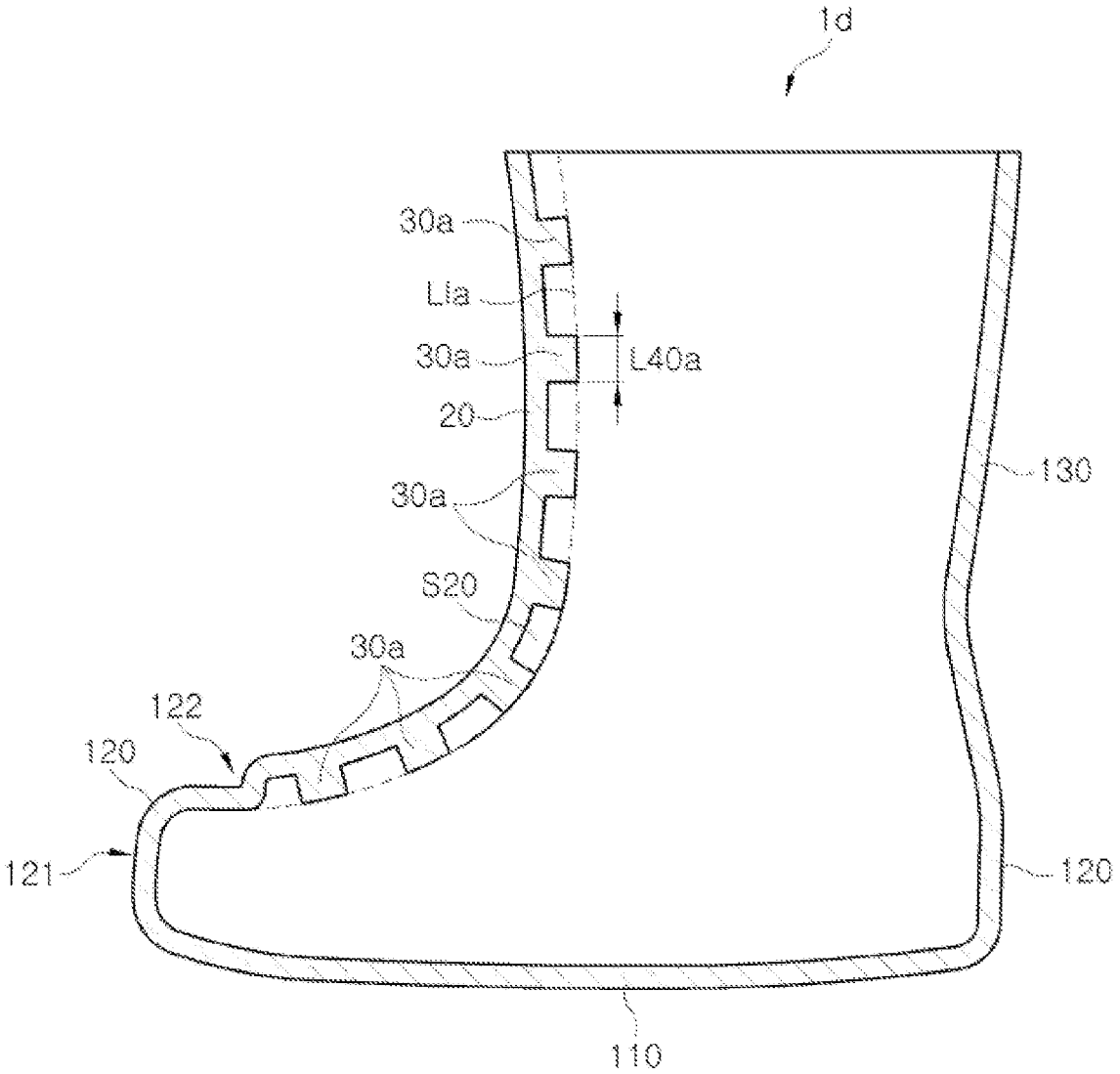
FIG. 12 is a cross-sectional view taken along line III-III of FIG. 1, illustrating shoes according to another embodiment of the present disclosure.
Figure 13:
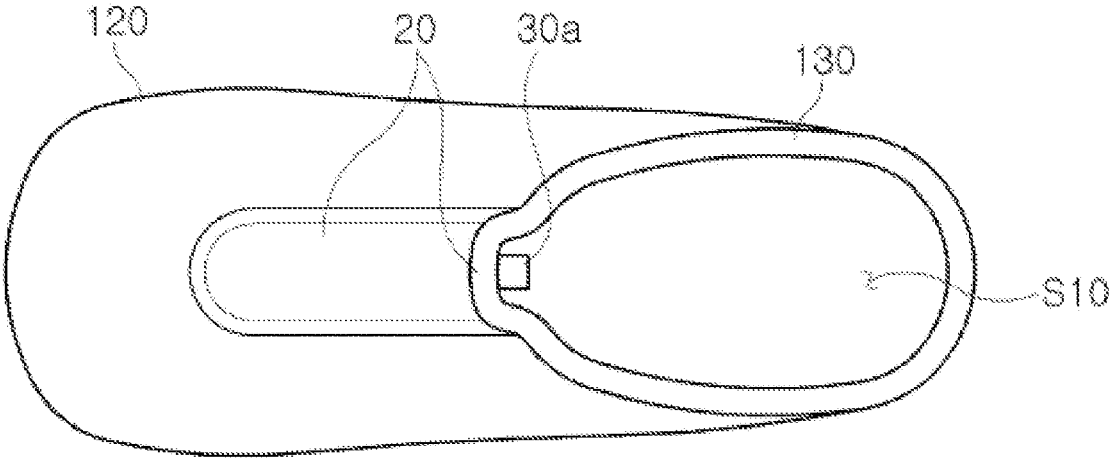
FIG. 13 is a plan view of an example of the shoes shown in FIG. 12.

Compared with the shoes 1 shown in FIGS. 1 to 4, the shoes 1*d* shown in FIGS. 12 and 13 has the same structure as the shoes 1 of FIGS. 1 to 4 except for a foot support portion 30*a*.

Accordingly, the shoes 1*d* of FIGS. 12 and 13 also include a body 10 including a bottom portion 110, an instep portion 120, and an ankle portion 130, an air passage portion 20 protruding from the front of the body 10 in an outward direction, and a plurality of foot support portions 30*a* attached to the air passage portion 20.

Here, the plurality of foot support portions 30*a* are located in an extending direction of the air passage portion 20 and spaced apart from each other at a predetermined interval on an inner surface of the air passage portion 20, rather than being located between both sides of the inner surface of the air passage portion 20.

Each foot support portion 30*a* has a predetermined cross-sectional shape such as a square or circle, has a form of a foot column from the inner surface of the air passage portion 20, and formed as a protrusion protruding toward a foot insertion space S10.

Therefore, an air passage 20 is a space between the inner surface of the air passage portion 20 and a virtual line L1*a* formed by connecting the ends of each foot support portion 30*a*, and the foot insertion space S10 is a space surrounded by the virtual line L1*a*, the bottom portion 110, the instep portion 120, and the ankle portion 130.

Here, a protrusion height of each foot support portion 30*a* is different according to a mounting position, a length L40 is also different according to the mounting position, and a shape of each foot support portion 30*a* may be determined according to a shape of the user's body in contact therewith.

In addition, a distance between the foot support portions 30*a*, which are spaced apart from each other in the extending direction of the air passage portion 20, is the same but may be different depending on a position, so that activity of the shoes 1*d* for a shoes bending operation, etc. may be increased.

Fibers may be attached to a surface of each foot support portion 30*a*, that is, a surface in contact with the user's body.

The foot support portion 30*a* may be formed of the same material as the body 10.

Figure 14:
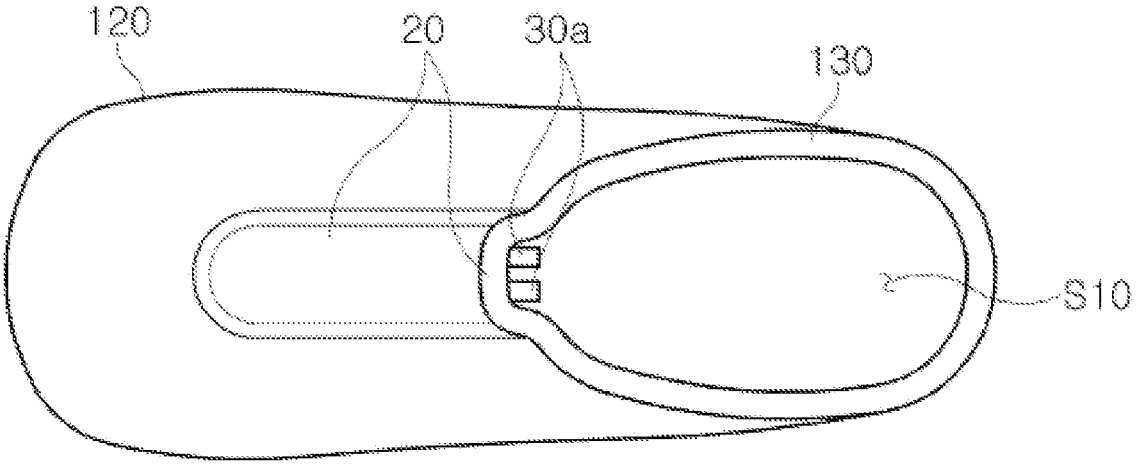
FIG. 14 is a plan view of another example of the shoes shown in FIG. 12.

In FIGS. 12 and 13, one foot support portion 30*a* is located at a corresponding position of the air passage portion 20, but the present disclosure is not limited thereto, and as shown in FIG. 14, in an alternative example, a plurality of foot support portions 30*a* spaced apart from each other in a width direction of the air passage portion 20 may be located at the same height of the air passage 20. Here, the number of foot support portions 30*a* located side by side in the width direction may vary depending on the position, so that one foot support portion 30*a* is located in the width direction at the air passage portion 20 adjacent to the ankle portion, while a plurality of foot support portions 30*a* may be located in the width direction at the air passage portion 20 adjacent to the instep and the calf.

The protrusion-shaped foot support portion 30*a* may be used together with the foot support portion 30 shown in FIGS. 1 to 4.

Figure 15:
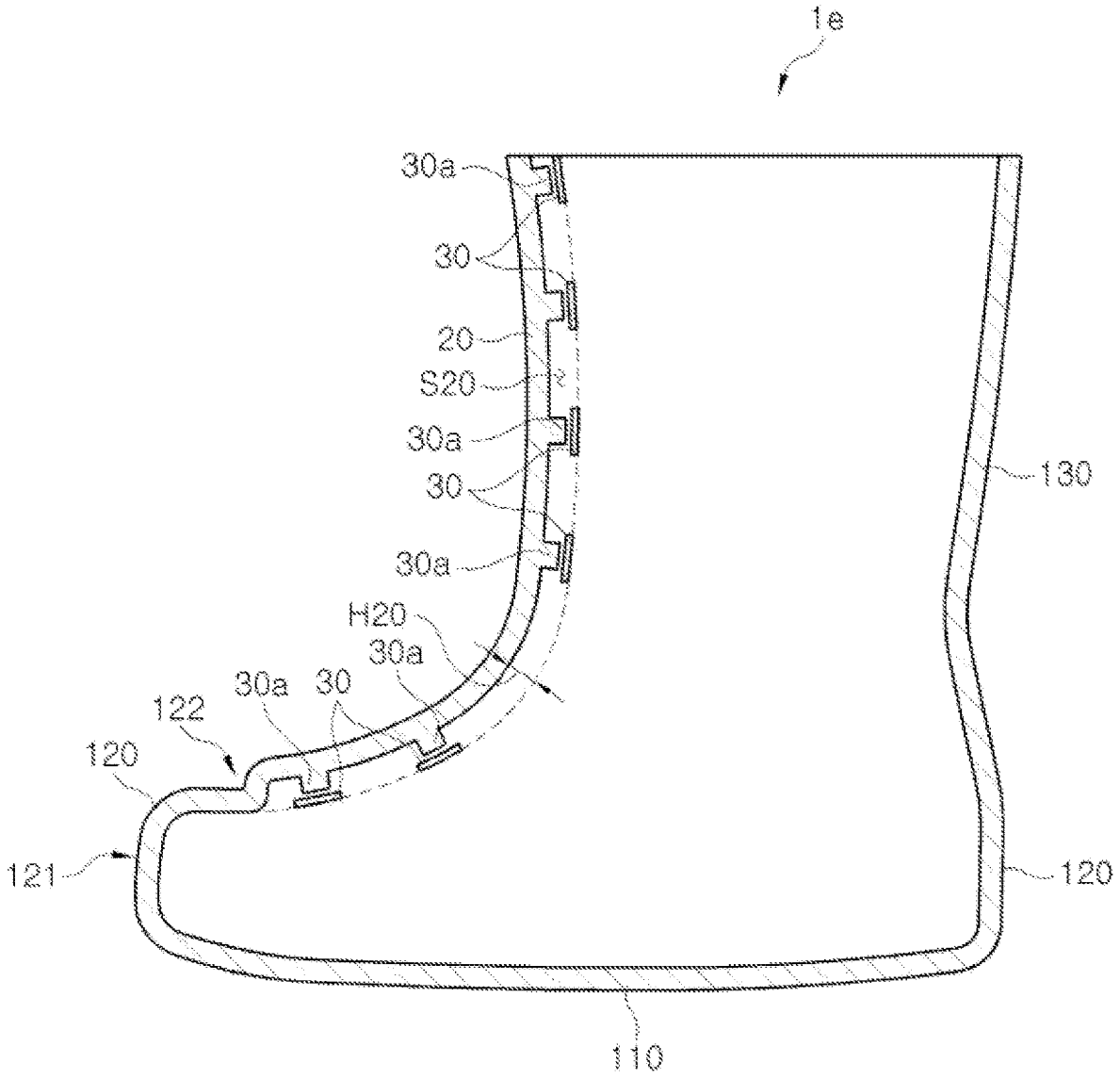
FIG. 15 is a cross-sectional view taken along line III-III of FIG. 1, illustrating shoes according to another embodiment of the present disclosure.

That is, in shoes 1*e* shown in FIG. 15, a plurality of protrusions 30*a* protruding from an inner surface of the air passage portion 20 toward the foot insertion space S10 are located to correspond to the foot support portion 30.

Accordingly, the foot support portion 30 formed in the form of a band or belt may be a first foot support portion, and the foot support portion formed in the form of a protrusion may be a second foot support portion. Therefore, the first foot support portions 30 and the second foot support portions 30*a* face each other, respectively.

In this manner, when the first and second foot support portions 30 and 30*a* are located to be spaced apart from each other in the extending direction of the air passage portion 20, a function of supporting the feet and legs by the first and second foot support portions 30 and 30*a* may be improved, thus improving activity and convenience of the shoes 1*e*.

Also, in this case, the second foot support portion 30*a* located at the same height may include a plurality of foot support portions 30*a* spaced apart from each other in the width direction of the air passage portion 20.

Figure 16:
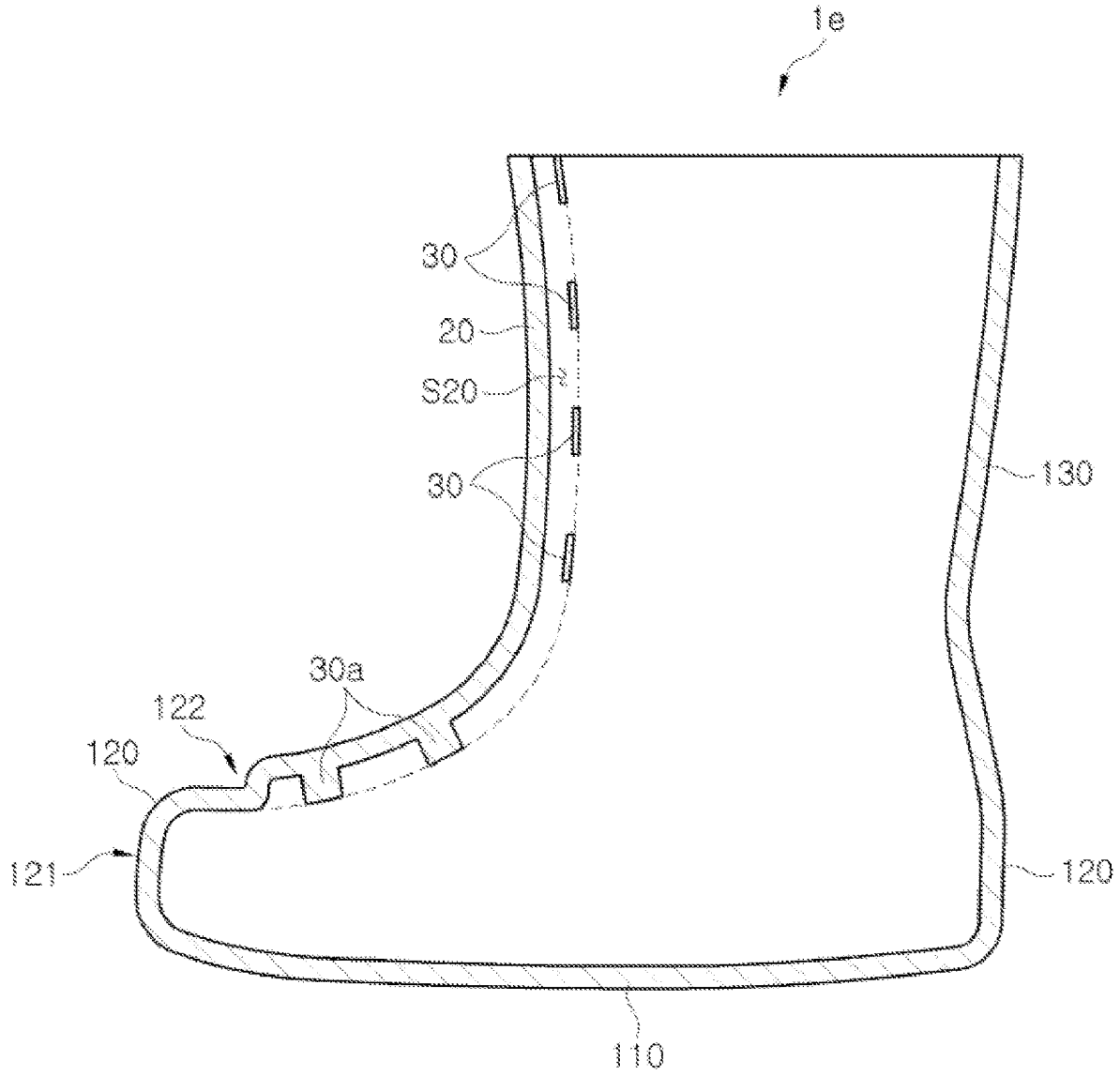
FIG. 16 is a cross-sectional view taken along line III-III of FIG. 1, illustrating shoes according to another embodiment of the present disclosure.
Figure 17:
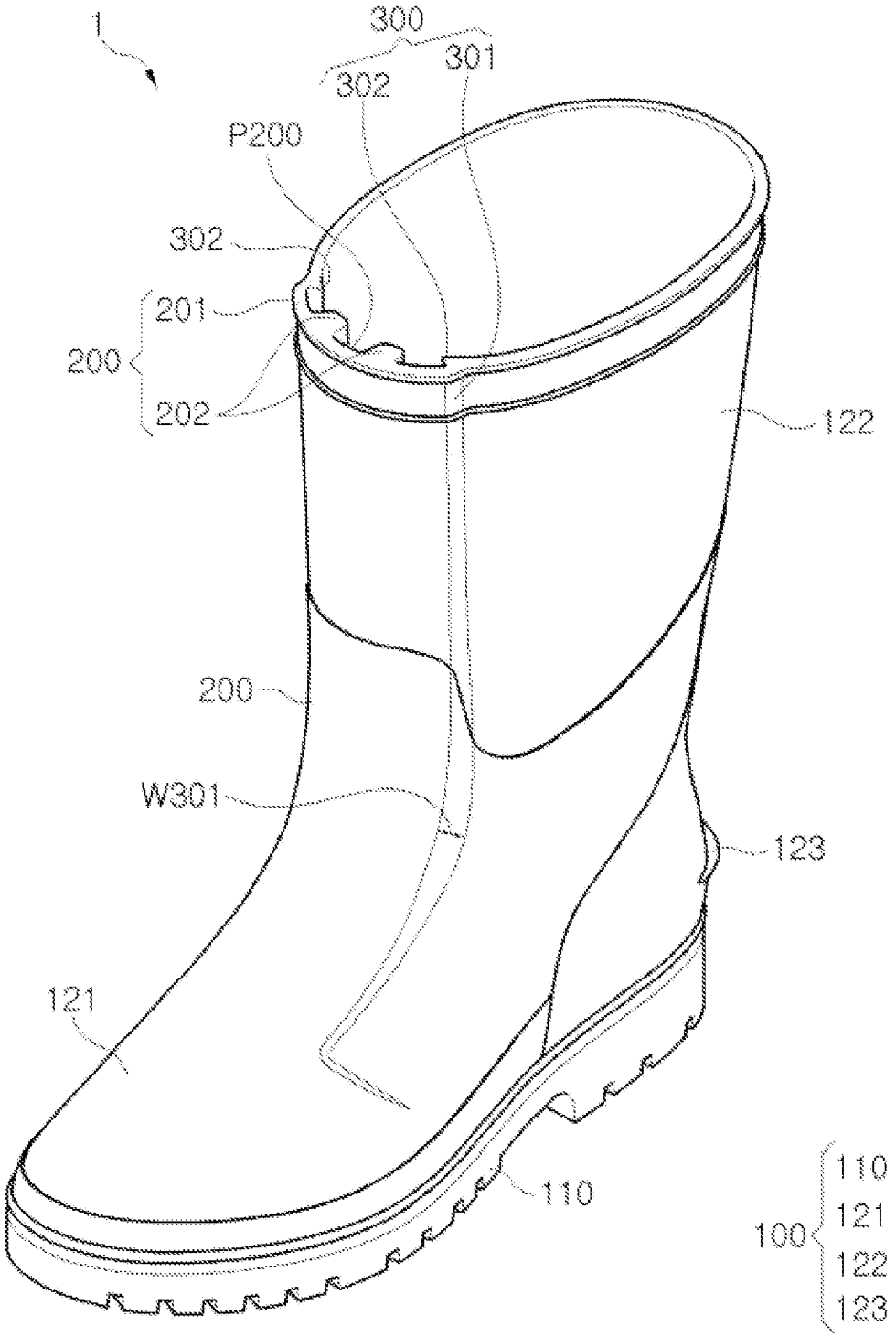
FIG. 17 is a perspective view of shoes according to an embodiment of the present disclosure.
Figure 18:
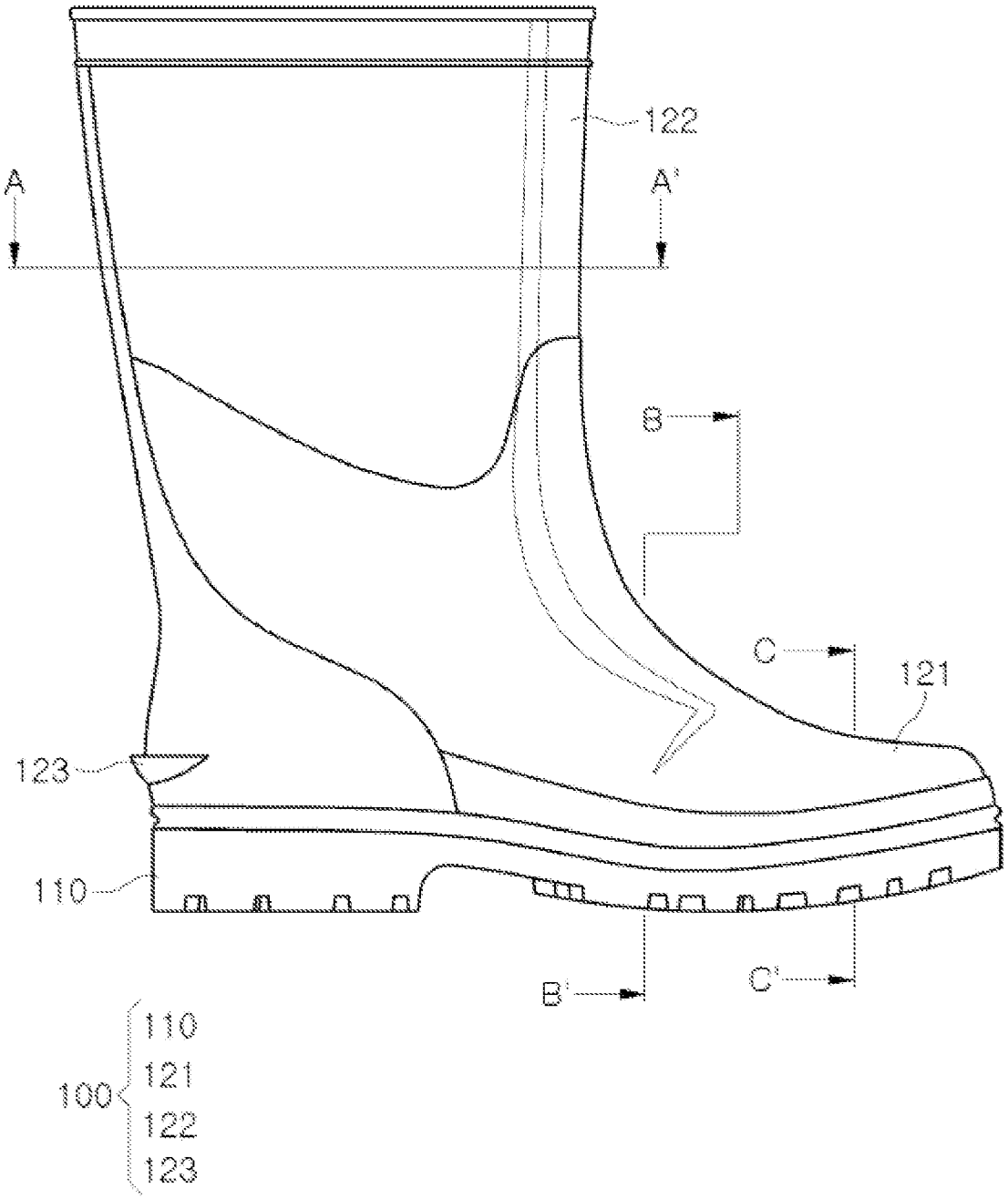
FIG. 18 is a side view of the shoes shown in FIG. 17.
Figure 19:
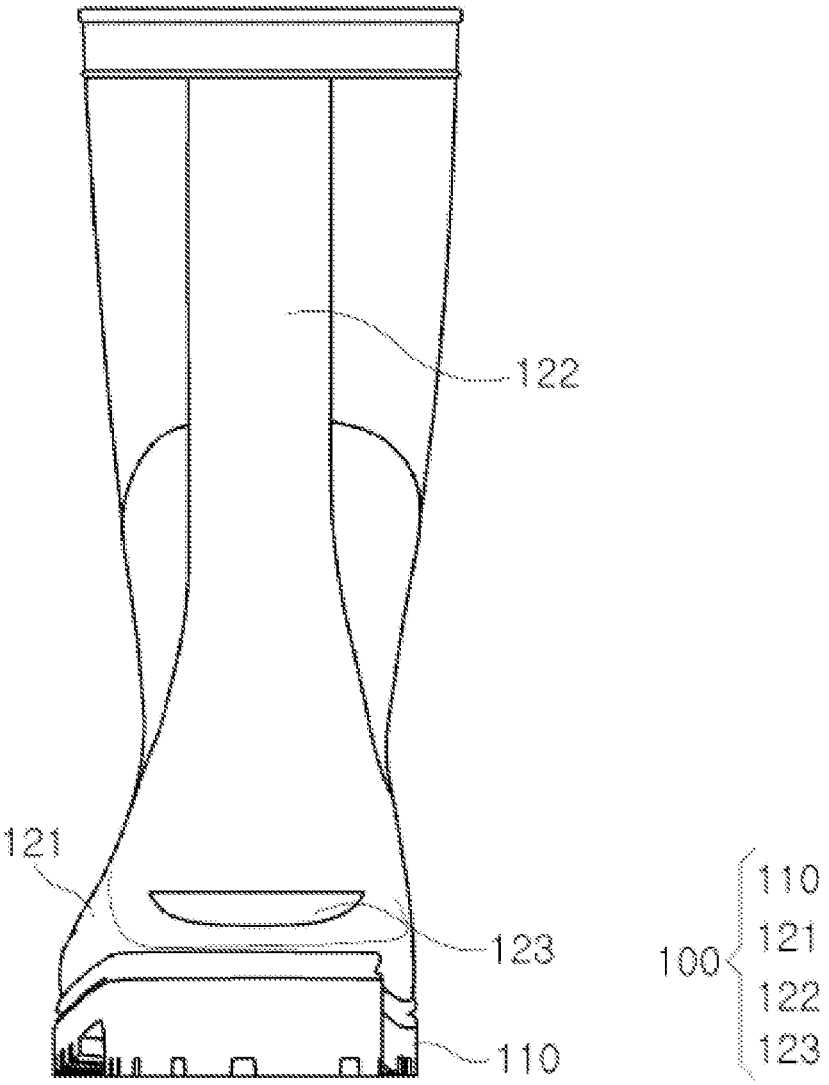
FIG. 19 is a rear view of the shoes shown in FIG. 17.

In addition, in other shoes 1*f* shown in FIG. 16, the first foot support portion 30 in the form of a band or belt or the second foot support portion 30*a* in the form of a protrusion may coexist according to the position of the air passage portion 20.

In this case, the first or second foot support portions 30 and 30*a* may be used depending on the shape of the user's body adjacent to the foot support portions 30 and 30*a*.

The insoles 50 and 50*c* illustrated in FIGS. 6, 8 and 11 may be applied to the shoes 1*d* to 1*f* illustrated in FIGS. 12 to 16. In the present disclosure, the lower surfaces of the bottom portions 110 and 110*b* of the shoes 1, 1*a* to 1*f* in direct contact with the floor are shown as flat surfaces, but are not limited thereto, and may be uneven surfaces including depressions and protrusions formed in various shapes to prevent slipping, etc.

Hereinafter, shoes 1 according to another embodiment of the present disclosure will be described in detail with reference to FIGS. 17 to 24.

As shown in FIGS. 17 to 24, the shoes 1 according to an embodiment of the present disclosure may include a body 100, a cover portion 200 located on a front side of the body 100, and a shape support portion 300 located between the body 100 and the cover portion 200.

The body 100, a portion in which a wearer's foot is inserted and the foot is worn, includes a bottom portion 110, a first body portion 121 connected to the bottom portion 110, and a second body portion 122 connected to the bottom portion 110 and the first body portion 121.

The bottom portion 110 is a portion in which each of lower portions of the wearer's sole, i.e., the forefoot, midfoot, and rearfoot, is located, and contacts the sole of the wearer when shoes are worn. Here, the forefoot is a portion in which toe bones and metatarsal bones are mainly located, the midfoot is a portion in which the ankle bone is mainly located, and the rearfoot may be a portion in which calcaneus and the talus bone are located.

The first body portion 121 and the second body portion 122 extend from the bottom portion 110 and are seamlessly connected to each other and surround the instep of the worn foot. Here, depending on a length of the body 100 extending in a vertical direction with respect to the ground, that is, a length of the shoes 1 extending toward the body of the wearer, the body 100 may wrap not only the instep but also the ankle and additionally wrap the leg.

The first body portion 121 is a portion that covers the wearer's instep, specifically, a portion of the forefoot, that is, a side portion of a portion of the forefoot in which the toe bones and partial metatarsal bones are located and the instep portion.

Accordingly, the body 100 includes an internal space (e.g., first internal space) S11 surrounded by a first body portion 121 and a portion of the bottom portion 110 corresponding thereto, and the forefoot is mainly located in the first internal space S11.

The second body portion 122 is a portion in which the rest of the midfoot and the rearfoot of the wearer is located, and mainly wraps a side portion of the midfoot and rearfoot of the corresponding portion.

As described above, the second body portion 122 is connected to the first body portion 121, is also connected to the rest of the bottom portion 110 not connected to the first body portion 121, and extends toward the wearer's body.

Since a front portion of the second body portion 122 is covered with the cover portion 200, a front portion of the second body portion 122 extending along the extending direction of the second body portion 122, that is, the front portion corresponding to the instep in the midfoot and the rearfoot, is opened by a predetermined width. Here, when the shoes 1 is a boot like this example, the opened front portion naturally extends to a shin portion in which a shin bone is located.

Accordingly, the body 100 has an internal space (e.g., a second internal space) S12 surrounded by the second body portion 122 and the rest of the bottom portion 110 corresponding thereto, and the cover portion 200, and the midfoot and the rearfoot are mainly located in the second internal space S12. Here, it is natural that the first internal space S11 and the second internal space S12 are connected to each other.

In this manner, the foot of the wearer is inserted into the first and second internal spaces S11 and S12 formed by being surrounded by the bottom portion 110, the first and second body portions 121 and 122, and the cover portion 200.

Depending on the extending length of the second body portion 122 extending toward the wearer's body, the shoes 1 of the present example may have a form of boots in which up to the wearer's calf is inserted or have a form of ankle boots in which up to the wearer's ankle is inserted. In addition, the shoes 1 of the present example may be manufactured as shoes of another form by adjusting the extending length or shape of the second body portion 122.

The body 100 has an arrest projection 123 protruding from a rear outer surface of the second body portion 122 corresponding to the rearfoot. The arrest protrusion 123 is to increase convenience of the wearer when the wearer takes off the shoes 1. That is, when the wearer wants to take off a corresponding shoe (e.g., the left shoe), the wearer may step on the arrest protrusion 123 by the other shoe (e.g., the right shoe) or foot to take off the corresponding shoe 1 more conveniently.

The cover portion 200 covers a front portion of the first body portion 122 which is an open portion of the body 100.

The cover portion 200 has a predetermined width W200 to cover the front portion of the open second body portion 122 and protrudes outward from the second body portion 122.

Accordingly, the cover portion 200 extends from the beginning of the second body portion 122 in contact with the first body portion 121 to the end of the second body portion 122 along the extending direction of the second body portion 122.

The cover portion 200 also performs a function of quickly discharging sweat or odor generated from the inside of the shoes 1 to the outside.

The cover portion 200 includes a cover 201 covering an open portion of the front portion of the body 100 and a plurality of protrusions 202 protruding from an inner surface of the cover 201, i.e., from a surface in contact with the second internal space S12 toward the second internal space S12.

The cover 201 has the same thickness regardless of position, and an outer surface and an inner surface thereof are curved according to an appearance of the foot and leg to be inserted.

A thickness of the cover 201 may be equal to or smaller than a thickness of the first and second body portions 121 and 122.

Therefore, excluding a portion into which the foot is inserted to wear the shoes, i.e., an upper portion of the second body 122, the body 100 is fully covered by the bottom portion 110, the first body portion 121, the second body portion 122, and the cover 201.

A width of the cover 201, that is, a width W200 of the cover portion 200, may be the same regardless of height of the cover portion 200 or may be narrowed toward the bottom portion 110.

Figure 20:
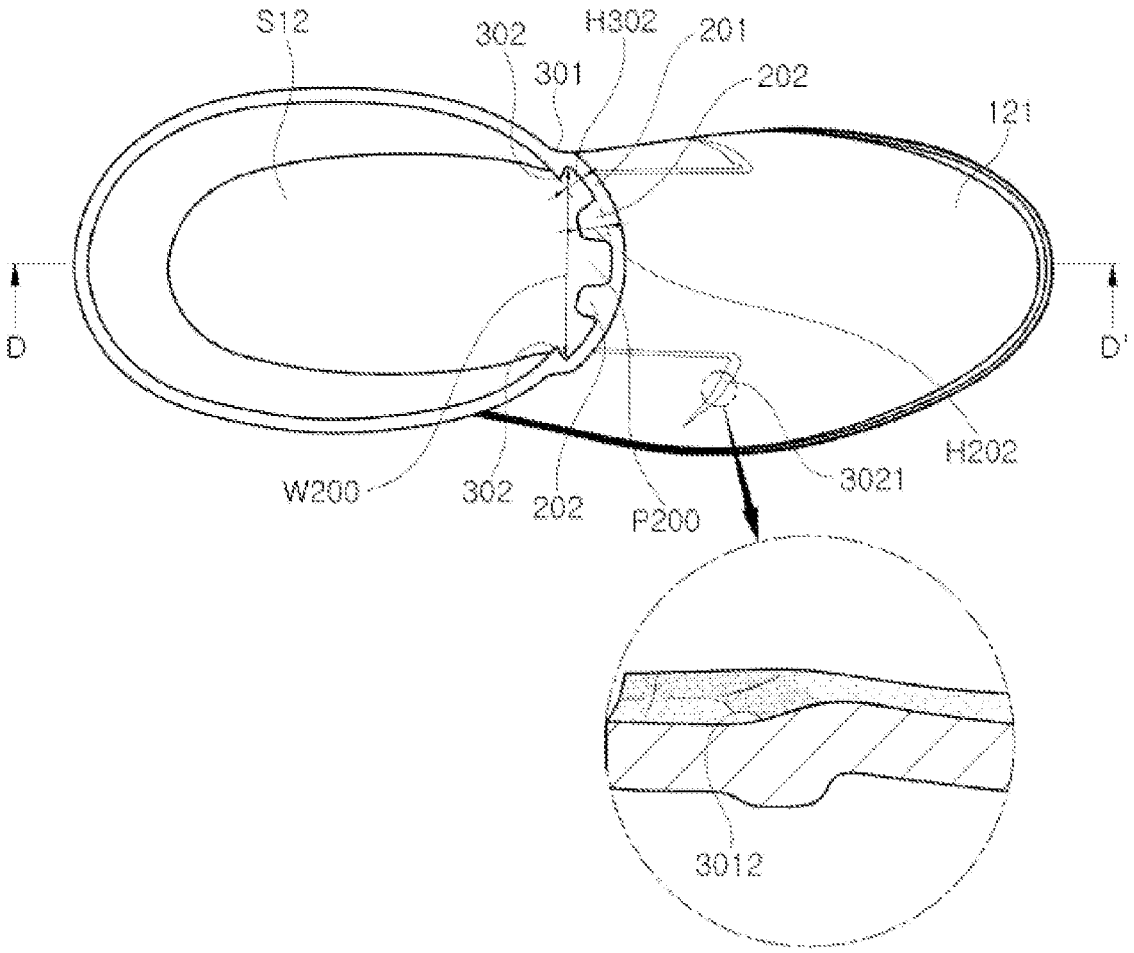
FIG. 20 is a plan view of the shoes shown in FIG. 1, in which an extending portion is enlarged in a circle.

The width W200 of the cover 201 may be of a size such that heat or sweat occurring in the shoes is efficiently discharged without causing discomfort of the wearer who wears the shoes and the appearance of the shoes, for example, within a range from 5 cm to 10 cm. In this example, the width W200 of the cover 201 may be a length when both edges of the inner surface of the cover 201 are connected by a virtual straight line in a horizontal direction as shown in FIG. 20.

The plurality of protrusions 202 are located on the inner surface of the cover 201 and spaced apart from each other in a horizontal direction of the cover 201 by a predetermined distance.

Accordingly, the cover portion 200 is divided into a portion in which the protrusion 202 is not located (e.g., a first portion) and a portion in which the protrusion 202 is located (e.g., a second portion). A thickness of the first portion is equal to a thickness of the cover 201, and a thickness of the second portion is equal to the sum of the thickness of the cover 201 and the thickness of the protrusion 202.

Accordingly, the first portion forms a concave portion recessed by the two protrusions 202 adjacent to both sides, and this concave portion is a discharge passage P200 as an air passage through which air flows between the inside and the outside of the shoes 1 to discharge sweat or odor occurring inside the shoes.

A width of the discharge passage P200 may be 0.5 cm to 3 cm.

Each protrusion 202 has a cross-sectional shape such as a square or a circle and extends in a straight line seamlessly from the beginning to the end of the cover 201 along the extending direction of the cover 201.

Figure 21:
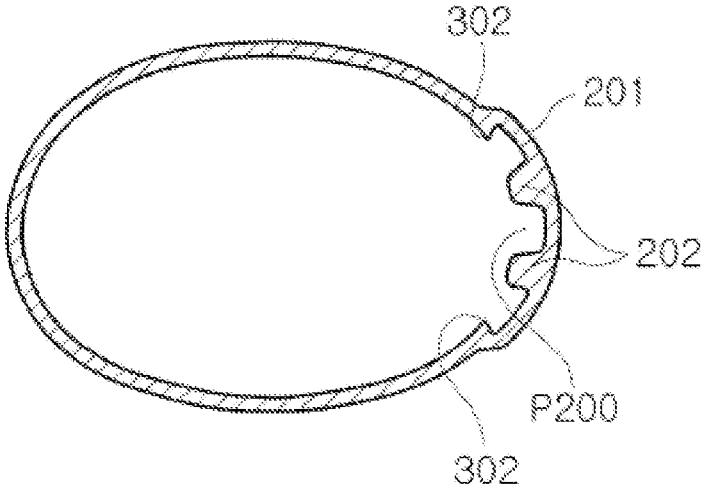
FIG. 21 is a cross-sectional view taken along line A-A' of FIG. 18.

In this example, a protruding thickness H202 of each protrusion 202 varies according to distances between the wearer's body inserted in the second internal space S12 and the inner surface of the cover 201, as shown in FIG. 21 and decreases in a direction from an upper end (i.e., an end portion) of the cover 201 to a lower end (i.e., a start portion in contact with the first body portion 121).

Further, in this example, the protruding thicknesses H202 of different protrusions 202 located at the same height are the same or may be different.

If the protruding thicknesses H202 of the protrusions 202 located at the same height are different, the protruding thickness H202 of the protrusion 202 may vary according to distances between the wearer's body inserted into the second internal space S12 and an inner surface of the cover 201.

Therefore, a planar shape of the inner surface and the outer surface of the cover 201 is formed as a curved surface as shown in FIG. 20, and thus, the protruding thickness H202 of the protrusion 202 may increase from edge portion (i.e., both side portions adjacent to the shape support portion 300) of the cover 201 toward a middle portion thereof at the same height.

In addition, a step difference between the second body portion 122 and the cover 201 caused by the cover 201 protruding outward from the second body portion 122 is compensated by the protrusion 202. Therefore, a movement range of the wearer's feet and legs inserted in the shoes 1 is limited by the protrusion 202, so that the wearer wears the shoes 1 comfortably and safely despite the presence of the covers 201 and 200 protruding to the outside.

When the shoes of this example are ankle boots or long boots, not only the instep but also the ankle portion or the shin portion is supported by the protrusion 202.

In addition, since the protrusion height of the protrusion 202 varies according to a thickness or shape of the wearer's body located in the second internal space S12, the comfort and convenience of the shoes are further improved. However, unlike this example, a single protrusion 202, not a plurality of protrusions 202, may be provided. In addition, in the present example, the extending lengths of all the protrusions 202 are the same, but unlike this, a protrusion 202 may have an extending length different from those of the other protrusions 202 depending on the formation position.

The shape support portion 300 is located between both edge portions of the second body portion 122 in contact with the open portion and both edge portions of the cover 201 (i.e., the left edge portion and the right edge portion of the cover 201), and extends long along the extending direction of the second body portion 122.

Accordingly, the cover 201 is attached to be connected to the second body portion 122 by the shape support portion 300.

In this example, each shape support portion 300 includes a main body 301 located between the edge portion of the second body portion 122 and the edge portion of the cover 201 which have a plate shape, are adjacent to each other, and face each other and a support protrusion 302 protruding from the inner surface of main body 301 toward the second internal space S12.

A width W301 of the main body 301 is different depending on a position. The width W301 of the main body 301 may increase in a direction toward a talus portion in which a talus bone adjacent to a tarsus of the wearer's foot is located at an upper end of the main body 301 or in a direction from a lower end of the main body 301 toward the talus portion.

As described above, since the main body 301 protrudes forwardly from an outer surface of the second body portion 122, the main body 301 of the shape support portion 300 is located obliquely between the cover 201 and the second body portion 122.

The support protrusion 302 is located adjacent to a first edge portion, which is an edge portion adjacent to the cover 201, among both edge portions (i.e., the first edge portion and a second edge portion) of the corresponding main body 301 and has a shape of a thin band extending along the extending direction of the shape support portion 300.

Figure 22:
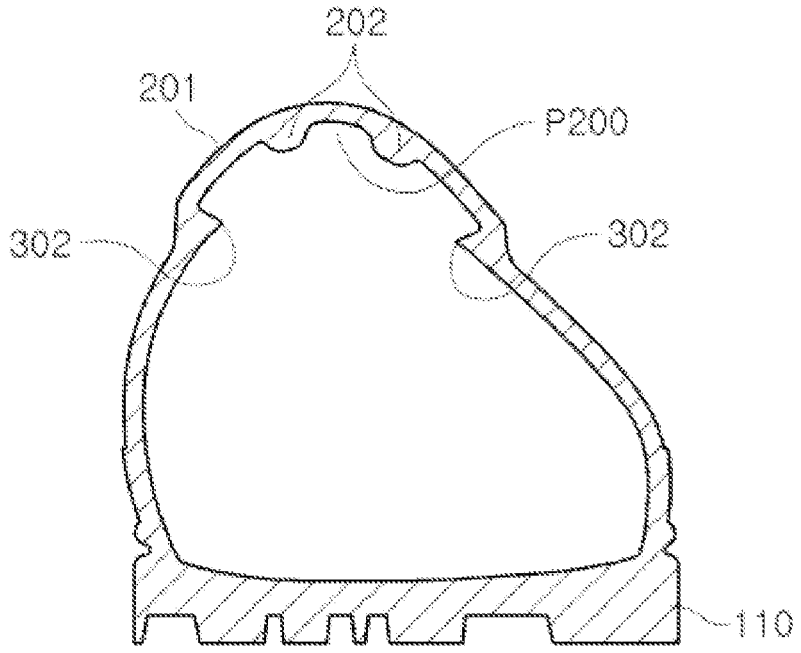
FIG. 22 is a cross-sectional view taken along line B-B' of FIG. 18.
Figure 23:
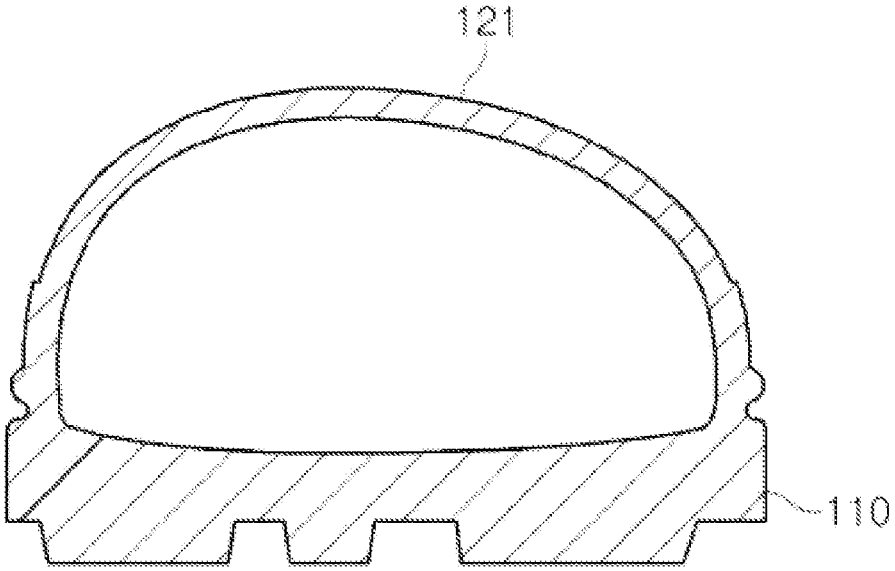
FIG. 23 is a cross-sectional view taken along line C-C' of FIG. 18.
Figure 24:
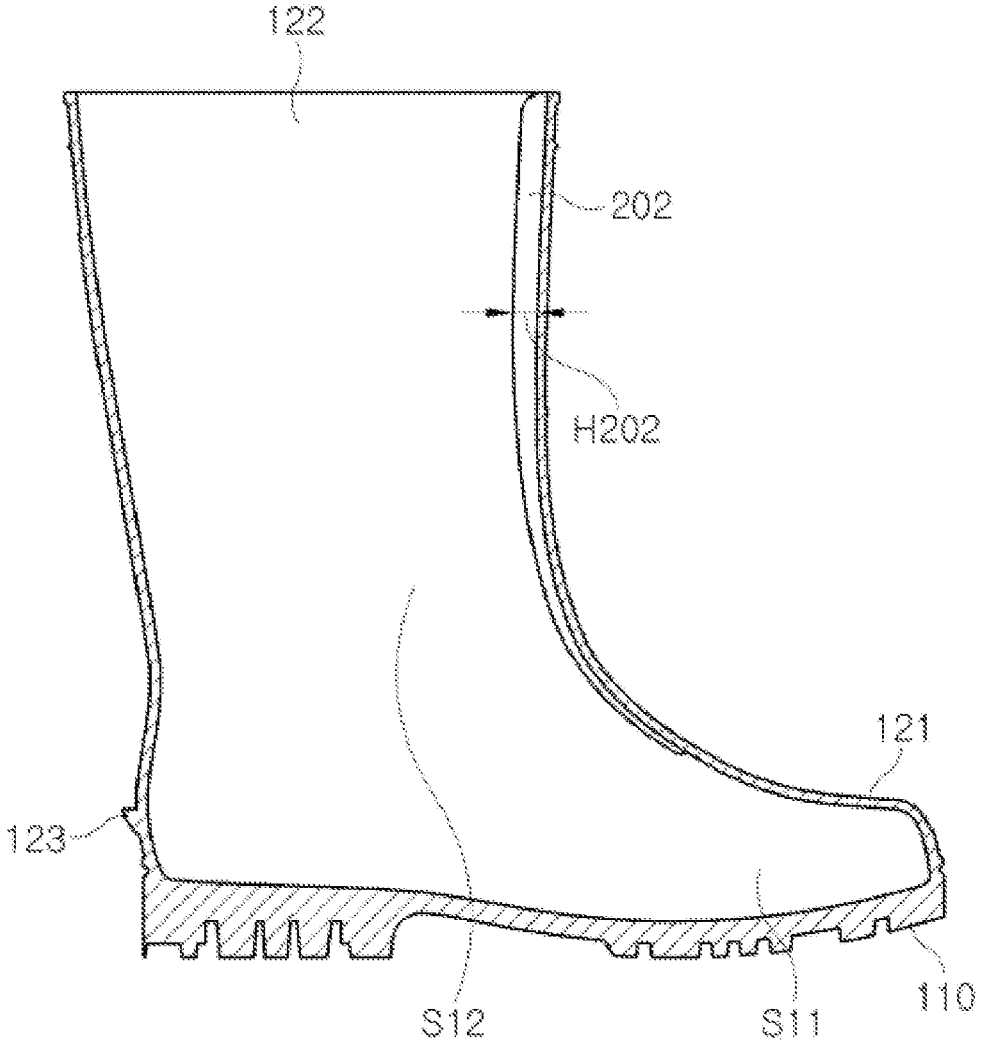
FIG. 24 is a cross-sectional view taken along the line D-D' of FIG. 20.

In this example, a thickness of the support protrusion 302 may increase to traverse in a direction from the second edge portion located on the opposite side of the first edge portion and connected to the second body portion 122 toward the first edge portion, so that the protrusion 302 may have a triangular planar shape as shown in FIGS. 20 to 22.

Here, an inner surface of the support protrusion 302 adjacent to the wearer's foot may be a curved surface. As such, since the portion that directly touches the wearer's feet and legs (that is, the inner surface of the support protrusion 302) that maintains the curved shape when wearing the shoes is formed of a curved surface and is designed ergonomically, a reduction in wearability or inconvenience due to the support protrusion 302 protruding toward the wearer's body may be prevented.

A maximum thickness H302 of the support protrusion 302 is smaller than a maximum thickness H202 of the protrusion 202 but is greater than a maximum thickness of the cover 201 and a maximum thickness of the second body portion 122.

Therefore, due to the thickness of the support protrusion 302, the shape support portion 300 located at a step portion of the air passage portion 200 and the second body portion 122 may more easily and efficiently support the shoes 1.

In this example, the support protrusion 302 extends to a boundary between the first body portion 110 and the second body portion 120 as described above, so that a lower end of the support protrusion 302 located at the boundary between the first and second body portions 110 and 120 is located at approximately the end of the corresponding metatarsal bone in contact with a big toe bone.

As shown in FIG. 20, the shape support portion 300 further includes an extending portion 30221 extending by a predetermined length in a direction intersecting the support protrusion 302 from a lower end of each support protrusion 301, approximately in the right or left direction, toward the bottom portion 110.

Here, a protrusion height of an extending portion 3021 of the support protrusion 302 extending toward the bottom portion 110 in the corresponding direction decreases toward the bottom portion 110 in the corresponding direction, and thus, an inner surface of the extending portion 3021 is located to be coplanar with the inner surface of the first body portion 121.

Since the extending portion 3021 protrudes outward from outer surfaces of the first and second body portions 110 and 120, a height of the outer surface of the extending portion 3021 is greater than a height of the outer surfaces of the first and second body portions 110 and 120.

In this manner, since the extending portion 3021 extends in a direction intersecting the extending direction of the support protrusion 302 and the height of the outer surface is also higher than the periphery, when the wearer wears the shoes 1, the shoes 1 may be easily bent at an immediately below the extending portion 3021. Therefore, the convenience of the wearer is further improved.

In the shoes 1 of the present example, if the shape support portion 300 and the protrusion 202 do not exist, a support force of the shoes may decrease, so that the shoes may be folded or collapsed when the shoes are erected. Therefore, since the shoes 1 of the present example has at least one of the shape support portion 300 and the protrusion 202, the support force of the shoes 1 is improved to be stably erected. The body 100, the cover portion 200, and the shape support portion 300 may be formed of the same material, and for example, may be formed of a material having elasticity such as natural rubber, synthetic rubber, or synthetic resin such as polyurethane foam or polypropylene.

However, in an alternative example, the bottom portion 110 of the body 100 may be formed of a material different from that of the other portions 121 and 122 of the body 100, and also in this case, the shoes 1 may be formed of natural rubber or a material such as synthetic rubber or synthetic resin.

Figure 25:
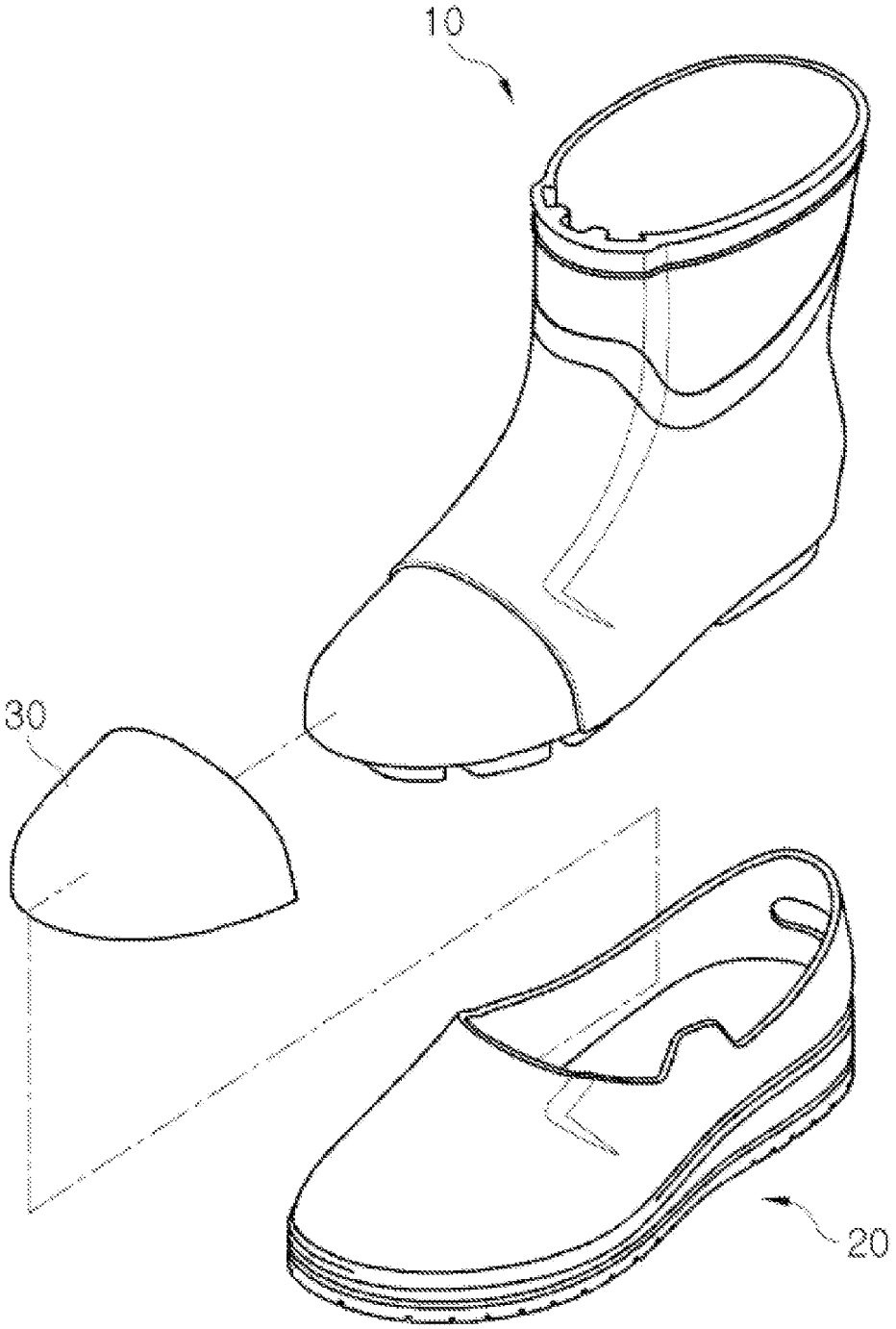
FIG. 25 is a schematic exploded perspective view of shoes according to another embodiment of the present disclosure.

Next, another embodiment of the present disclosure will be described with reference to FIG. 25.

Components having the same structure and perform the same function compared to those illustrated in FIGS. 17 to 24 are denoted by the same reference numerals as those in FIGS. 17 to 24 and detailed descriptions thereof will be omitted.

Compared with the case of FIGS. 17 to 24, the shoes 1*a* of this example includes an inner shoe 10, an outer shoe 20, and a protective member 30 located between the inner shoe 10 and the outer shoe 20.

Here, the inner shoe 10 has the same structure as that described above with reference to FIGS. 17 to 24 except for a structure of the bottom portion 110 and a thickness of a portion in which the protective member 30 is located. Detailed description thereof will be omitted. In addition, the inner shoe 10 of the present example may not have the arrest protrusion 123.

The protective member 30 serves to protect the toe of the wearer from an external impact by covering the forefoot of the first body portion 121 of the inner shoe 10.

Therefore, such a protective member 30 may be located on an outer surface of the forefoot of the inner shoe 10 or an inner surface corresponding to the forefoot in the outer shoe 20, and may be formed of a high-strength synthetic resin such as reinforced plastic or a thin metal material having flexibility.

The protective member 30 may be detachably or fixedly attached to a corresponding portion of the outer surface of the inner shoe 10, or may be fixed to a corresponding portion of the inner surface of the outer shoe 20.

The inner shoe 10 is inserted into the outer shoe 20, and the outer shoe 20 wraps the inner shoe 10 inserted therein.

Accordingly, the protective member 30 located to correspond to the forefoot of the inner shoe 10 stably protects the forefoot of the inner shoe 10.

Here, in order to stably fix the position of the inner shoe 10 inserted in the outer shoe 20, the inner shoe 10 and the outer shoe 20 may have a coupling structure using a protrusion and a recess. Accordingly, a coupling recess and a coupling protrusion may be located in at least one of the instep portion and the sole portion corresponding to each other in the inner shoe 10 and the outer shoe 20.

The outer shoe 20 may be formed of a material having elasticity, such as natural rubber, synthetic rubber, or synthetic resin, like the inner shoe 10.

Here, the inner shoe 10 may be formed of a material allowing the inner shoe 10 to be more easily inserted into the outer shoe 20, and the outer shoe 20 may be formed of a material capable of supporting the inner shoe 10 more stably. Thus, as an example, the inner shoe 10 may have greater elasticity and flexibility than the outer shoes 20.

In the above, embodiments of the shoes of the present disclosure have been described. The present disclosure is not limited to the above-described embodiments and the accompanying drawings, and various modifications and variations may be made from the viewpoint of those of ordinary skill in the art to which the present disclosure pertains. Therefore, the scope of the present disclosure should be defined by the claims of the present disclosure as well as those equivalents to the claims.

The invention claimed is:

1. A shoe comprising:

a first body portion in which a portion of a front foot portion of a wearer can be positioned;

a second body portion connected to the first body portion and in which the other remaining portion of the front foot portion, a middle foot portion, and a rear foot portion of the wearer can be positioned;

a cover seamlessly connected to the second body portion and protruding in an outward direction from both edge portions;

at least one protrusion protruding from an inner surface of the cover and extending in a direction in which the second body portion extends;

a shape support portion located between an edge portion of the cover and an edge portion of the second body portion adjacent to the edge portion of the cover and having a thickness greater than those of the cover and the second body portion, wherein a protruding thickness of each protrusion of the at least one protrusion decreases from an upper portion toward the first body portion, the shape support portion includes:

a main body located between the edge portion of the second body portion and the edge portion of the cover adjacent to each other and facing each other; and a support protrusion protruding from an inner surface of the main body, the width of the main body increases in a direction from an upper end of the main body toward a crutch portion in which a talus of the wearer's foot can be located and in a direction from a lower end of the main body to the crutch portion of the wearer, a thickness of the support protrusion increases from an edge portion connected to the second body portion toward the cover, the shape support portion further includes an extension portion extending in a direction intersecting the support protrusion from a lower end of the support protrusion, a height of an outer surface of the extension portion is higher than heights of outer surfaces of the adjacent first and second body portions, and the shoe including the first body, the second body, the cover, the at least one protrusion and the shape support portion is made of a same material.

2. The shoe of claim 1, wherein, when the at least one protrusion comprises a plurality of protrusions spaced apart from each other across the inner surface of the cover.

3. The shoe of claim 2, further comprising:

a discharge passage located between two adjacent protrusions to discharge sweat or odor inside the shoes.

4. The shoe of claim 3, wherein a width of the discharge passage is 0.5 cm to 3 cm.

5. The shoe of claim 2, wherein protrusion heights of different protrusions located at the same level are the same or different.

6. The shoe of claim 5, wherein, when the protrusion heights of the different protrusions located at the same level are different from each other, the protrusion height increases from the edge portion of the cover toward the center.

7. The shoe of claim 2, wherein extending lengths of two adjacent protrusions are the same or different.

8. The shoe of claim 1, further comprising:

an arrest protrusion located on a rear outer surface of the second body portion.

* * * * *